US007422832B2

(12) United States Patent
Ogawa et al.

(10) Patent No.: US 7,422,832 B2
(45) **Date of Patent: *Sep. 9, 2008**

(54) MAGNETIC TONER

(75) Inventors: Yoshihiro Ogawa, Shizuoka (JP); Takashige Kasuya, Shizuoka (JP); Syuhei Moribe, Shizuoka (JP); Kouji Nishikawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/786,050

(22) Filed: Feb. 26, 2004

(65) Prior Publication Data

US 2005/0026060 A1 Feb. 3, 2005

(30) Foreign Application Priority Data

Jul. 30, 2003 (JP) ..... 2003-203863
Dec. 1, 2003 (JP) ..... 2003-401335

(51) Int. Cl.
*G03G 9/083* (2006.01)

(52) U.S. Cl. ..... 430/106.2; 430/108.23; 430/108.3; 430/109.4; 430/110.3; 430/111.41

(58) Field of Classification Search ..... 430/106.1, 430/106.2, 109.4, 110.3, 111.41, 108.23, 430/108.3

See application file for complete search history.

(56) References Cited

U.S. PATENT DOCUMENTS

| | | | | |
|---|---|---|---|---|
| 4,857,432 | A * | 8/1989 | Tanikawa et al. | 430/108.23 |
| 4,917,983 | A | 4/1990 | Uchida et al. | |
| 4,935,325 | A | 6/1990 | Kuribayashi et al. | 430/106.6 |
| 5,240,803 | A | 8/1993 | Ota | |
| 5,294,682 | A * | 3/1994 | Fukuda et al. | 525/442 |
| 5,750,303 | A | 5/1998 | Inaba et al. | |
| 5,853,937 | A | 12/1998 | Asanae et al. | 430/106.6 |
| 5,912,101 | A | 6/1999 | Karaki et al. | |
| 6,033,817 | A | 3/2000 | Yusa et al. | 430/106.6 |
| 6,197,470 | B1 * | 3/2001 | Tamura | 430/108.7 |
| 6,218,065 | B1 * | 4/2001 | Tanikawa et al. | 430/108.3 |
| 6,346,070 | B1 | 2/2002 | Ohmatsuzawa et al. | 529/279 |
| 6,379,855 | B1 * | 4/2002 | Hayashi et al. | 430/106.1 |
| 6,475,687 | B2 * | 11/2002 | Hayashi et al. | 430/106.2 |
| 6,485,875 | B1 * | 11/2002 | Karaki et al. | 430/108.23 |
| 6,677,092 | B2 * | 1/2004 | Arai | 430/106.1 |
| 7,029,813 | B2 * | 4/2006 | Mikuriya et al. | 430/108.1 |
| 2002/0055053 | A1 | 5/2002 | Kasuya et al. | 430/108.23 |
| 2002/0115011 | A1 | 8/2002 | Komoto et al. | 430/125 |
| 2003/0122911 | A1 | 7/2003 | Mizoo et al. | 347/95 |
| 2003/0158372 | A1 * | 8/2003 | Shirai et al. | 528/279 |
| 2004/0241565 | A1 * | 12/2004 | Kishiki et al. | 430/109.4 |
| 2005/0064313 | A1 * | 3/2005 | Kishiki et al. | 430/109.2 |

FOREIGN PATENT DOCUMENTS

| | | | |
|---|---|---|---|
| EP | 0 716 351 A2 | | 6/1996 |
| JP | 02-87157 | | 3/1990 |
| JP | 03-84558 | | 4/1991 |
| JP | 03-229268 | | 10/1991 |
| JP | 04-1766 | | 1/1992 |
| JP | 09-90670 | | 4/1997 |
| JP | 9-146297 | | 6/1997 |
| JP | 09-244299 | | 9/1997 |
| JP | 10-97095 | | 4/1998 |
| JP | 10-171150 | | 6/1998 |
| JP | 11-149176 | | 6/1999 |
| JP | 11-202557 | | 7/1999 |
| JP | 2001-64378 | | 3/2001 |
| JP | 2002-148867 | | 5/2002 |
| JP | 002-214829 | | 7/2002 |
| JP | 2003-202707 | * | 7/2003 |
| WO | WO 03/052521 | * | 6/2003 |
| WO | WO 03/073171 | * | 9/2003 |

OTHER PUBLICATIONS

American Chemical Society on STN File Registry No. 14481-26-6, copyright 2005.*
American Chemical Society on STN File Registry No. 36673-16-2, copyright 2005.*
Japanese Patent Office machine-assisted translation of JP 2003-202707 (pub. Jul. 18, 2003).*

* cited by examiner

*Primary Examiner*—Janis L Dote
(74) *Attorney, Agent, or Firm*—Fitzpatrick, Cella, Harper & Scinto

(57) ABSTRACT

Provided is a magnetic toner comprising magnetic toner particles each comprising at least a binder resin and a magnetic iron oxide, the magnetic toner being excellent in developability and environmental stability, and being capable of reducing a toner consumption. A saturation magnetization σs and a remanent magnetization σr of the magnetic toner in a measured magnetic field of 795.8 kA/m are arranged in the range of 5 to 60 $Am^2/kg$ and in the range of 0.1 to 10.0 $Am^2/kg$, respectively, and the binder resin having a polyester component polymerized by using a Ti chelate compound as a catalyst is used.

6 Claims, 2 Drawing Sheets

MAGNETIC TONER

BACKGROUND OF THE INVENTION

1. Field of the Invention

The present invention relates to a toner for use in an image forming method such as electrophotography, electrostatic printing, a magnetic recording method, or a toner jet method.

2. Description of the Related Art

Various toners have been heretofore proposed in order that fixability at a low temperature and hot offset resistance at a high temperature be compatible with each other. In particular, a toner using a binder resin having a polyester component has been used in a model such as a high-speed device where importance is placed on fixing performance because of its superior fixability and hot offset property. However, a polyester resin tends to contain water because the polyester resin is polymerized by a dehydration reaction. Moreover, the polyester resin tends to adsorb water owing to the presence of an acid group or a hydroxyl group at a terminal of its molecule. Therefore, the polyester resin is susceptible to the temperature and humidity of its use environment, so environmental characteristics of developability and chargeability of the toner tend to be unstable.

Machines such as a printer are required to achieve miniaturization from the viewpoints of energy conservation and space saving in an office, and containers for storing toners are also required to achieve miniaturization. Therefore, a toner enabling low toner consumption, that is, a toner with which many sheets can be printed out using only a small amount of the toner, has been demanded.

In the case where a binder resin having a polyester component is used for a magnetic toner, it is extremely important to control magnetic properties of the toner and the charging property of the binder resin to achieve low toner consumption. In particular, a polymerization catalyst for producing a polyester resin is important to enhance environmental stability of developability of the toner and to achieve low toner consumption because the polymerization catalyst has a profound effect on the charging property of the binder resin.

According to the techniques generally performed for producing a polyester resin for a toner, a tin-based catalyst such as dibutyltin oxide and dioctyltin oxide, or an antimony-based catalyst such as antimony trioxide is used as the polymerization catalyst. Those techniques are inadequate to provide the performance required of a magnetic toner, that is, a higher speed and greater environmental stability which will be further demanded from now on.

JP 2002-148867 A discloses a technique of using a titanate of an aromatic diol as a polymerization catalyst. JP 2001-064378 A discloses a technique of using a solid titanium compound as a polymerization catalyst.

However, polymerization of a polyester component through the use of a polymerization catalyst made of each of those titanium compounds is not adequate for controlling the chargeability of a magnetic toner.

In a one-component developing method using a magnetic toner which is preferably used in an electrophotographic developing method, the magnetic properties and chargeability of the magnetic toner significantly affect the toner consumption. In particular, in a magnetic toner using a polyester resin as its binder resin, it is necessary to comprehensively control chargeability, dispersibility of a magnetic iron oxide, magnetic properties of the magnetic toner, and so on by a combination of the resin and a magnetic material. JP 09-090670 A, JP 09-146297 A, JP 10-171150 A, and JP 2002-214829 A each disclose magnetic properties of a toner.

However, a polymerization catalyst for a polyester component and magnetic properties of a toner are not sufficiently studied in those publications, and thus there remains room for improvement.

JP 03-084558 A, JP 03-229268 A, and JP 04-001766 A each disclose a technique of forming a toner into an approximately spherical shape by means of a production method such as a spray granulation method, a dissolution method, or a polymerization method as a technique of modifying the shape of a toner. In addition, JP 02-087157 A, JP 10-097095 A, JP 11-149176 A, and JP 11-202557 A each disclose a technique of modifying the shape and surface characteristics of a particle of a toner produced by a pulverization method by applying a thermal or mechanical impact. However, modifying the shape of a toner by each of those methods alone does not facilitate a reduction in toner consumption while maintaining high environmental stability of developability of a magnetic toner using a polyester resin.

SUMMARY OF THE INVENTION

An object of the present invention is to provide a toner that overcomes the above problems, that is, a magnetic toner which is excellent in developability and environmental stability and allows low toner consumption.

The present invention relates to a magnetic toner comprising magnetic toner particles each comprising at least a binder resin and a magnetic iron oxide, wherein:

the magnetic toner has a saturation magnetization $\sigma s$ being in the range of 5 to 60 $Am^2/kg$ and a remanent magnetization $\sigma r$ being in the range of 0.1 to 10.0 $Am^2/kg$ in a measured magnetic field of 795.8 kA/m; and the binder resin contains a polyester component polymerized by using a Ti chelate compound as a catalyst.

DESCRIPTION OF THE PREFERRED EMBODIMENTS

Figure 1:
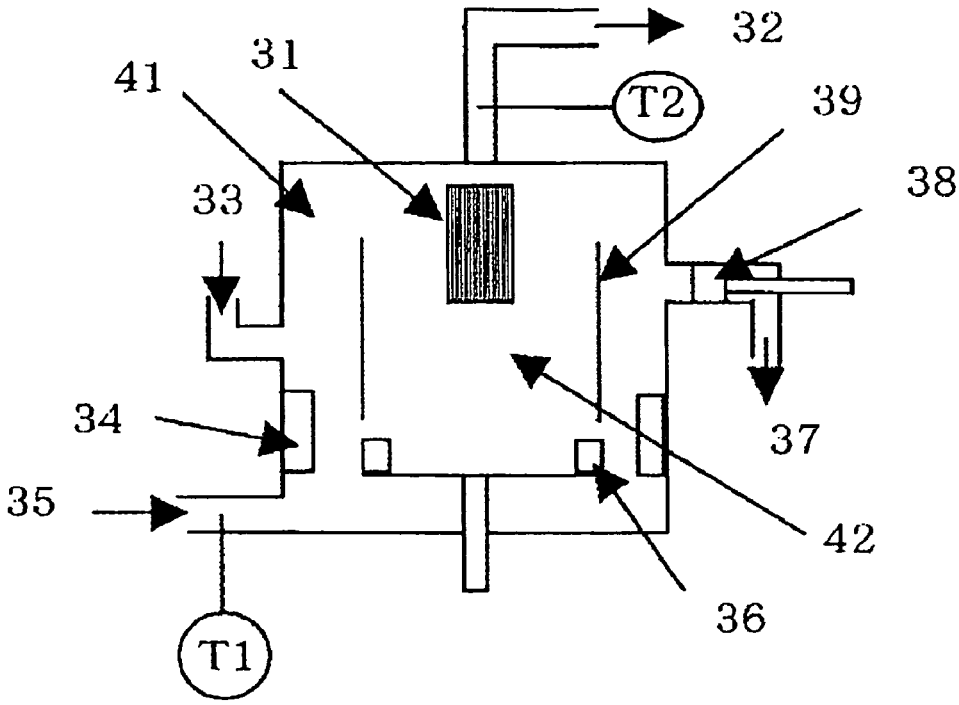
FIG. 1 is a schematic sectional view showing an example of a surface modification apparatus to be used in a surface modifying step of the present invention.

In the present invention, a resin having a polyester component using a Ti chelate compound as a catalyst is considered to uniformly contain a Ti compound. However, whether the Ti compound is present as a Ti chelate compound or is changed by a polymerization reaction into a compound other than a chelate compound has not been confirmed yet. However, it is hard to think that the Ti compound is present as a Ti metal, and there is a high possibility that the Ti compound is present as a compound. Therefore, a residual substance of the polymerization catalyst in the resin is expressed as a "Ti compound".

In a one-component developing method using a magnetic toner containing a magnetic iron oxide, lowering magnetic properties of the toner reduces a binding force of the toner to a developing sleeve and increases developing efficiency, thereby leading to an increased image density. However, the reduction in the binding force of the toner to the developing sleeve is liable to cause development of the toner in a non-image area, so that fog tends to increase. On the contrary, raising magnetic properties of the toner suppresses fog, but the image density tends to decrease. In addition, a magnetic brush of the toner on the developing sleeve enlarges, a toner bristle hardly loses its shape between a photoconductive drum and the developing sleeve upon development, and thus the toner is developed while the shape of the bristle is maintained. Therefore, the toner is developed in an image area on the photoconductive drum in a larger amount than is necessary, so the toner consumption tends to increase.

The inventors of the present invention have found out that use of a magnetic toner whose saturation magnetization σs being in the range of 5 to 60 $Am^2/kg$ and remanent magnetization σr being in the range of 0.1 to 10.0 $Am^2/kg$ in a measured magnetic field of 795.8 kA/m, and use of a binder resin having a polyester component polymerized by using a Ti chelate compound as a catalyst, allow excellent developability to be exhibited irrespective of the use environment of the toner. The inventors have also found out that the use of the magnetic toner is effective for reducing toner consumption.

This is probably because the Ti compound in the polyester component serves as a dispersant for a magnetic iron oxide and, as a result, dispersibility of the magnetic iron oxide in the resin markedly increases as compared to that in the case where a resin using a polymerization catalyst other than a Ti chelate compound is used. In this case, variations in magnetic iron oxide contents among toner particles become small, and a magnetic property distribution of every toner particle becomes extremely sharp. Therefore, each toner particle can provide magnetic properties as designed. Moreover, uniform dispersion of a magnetic iron oxide in the toner extremely hastens rising of charge of the toner, thereby instantaneously attaining a high charge amount for the toner. In addition, the uniform dispersion sharpens a charge amount distribution of each toner particle. Therefore, the toner can maintain excellent developability even in a circumstance such as a high-temperature and high-humidity environment where the toner is hardly charged.

Furthermore, the uniform dispersion of the magnetic iron oxide in the toner leads to uniform exposure of the magnetic iron oxide to the toner particle surface. Therefore, the magnetic iron oxide serves to leak excessive charge of the toner under a low-temperature and low-humidity environment, so that an appropriate charge amount can be obtained while the sharpness of a charge amount distribution of each toner particle is maintained. Thus, excellent developability can be obtained while fog is suppressed.

The control of magnetic properties of a toner with a sharp charge amount distribution and high charge as described above also reduces the toner consumption.

In a one-component developing method using a magnetic toner, at a developing part where a developing sleeve and a photoconductive drum are opposed, several to several tens of magnetic toners combine owing to a magnetic force of a magnet incorporated in the developing sleeve to thereby form a bristle. The bristle flies from the surface of the developing sleeve to the photoconductive drum owing to a developing bias, and then developed.

The toner of the present invention is excellent in dispersibility of a magnetic iron oxide, and exhibits only small variations in magnetic properties of each toner particle. Therefore, bristles having a uniform length can be formed on a developing sleeve. In addition, the control of magnetic properties of the toner can facilitate disentanglement of a bristle when the bristle flies to the photoconductive drum. Therefore, the toner is not developed on a latent image on the photoconductive drum in a larger amount than is necessary, so the toner consumption can be reduced. Furthermore, because of the charge amount of the toner is high and charge amount distribution is sharp at this time, the latent image on the photoconductive drum can be reproduced faithfully. In addition, the toner does not lie off an image area, and the toner is not consumed in a larger amount than is necessary to compensate for the charge of the latent image. Therefore, an effect of reducing the toner consumption can be further obtained.

The inventors of the present invention have found out that the above effect is not obtained unless a resin having a polyester component polymerized by using a Ti chelate compound as a catalyst is used for a magnetic toner and magnetic properties of the toner are controlled. The inventors of the present invention have confirmed that the above effect can not be achieved if a resin having a polyester component polymerized by using another catalyst is used, or by merely satisfying magnetic properties of the toner.

It is important in the present invention that the saturation magnetization as and the remanent magnetization or of a magnetic toner in a measured magnetic field of 795.8 kA/m are in the range of 5 to 60 $Am^2/kg$ and in the range of 0.1 to 10.0 $Am^2/kg$, respectively. A toner with such magnetic properties enables an ideal magnetic brush to be obtained on a developing sleeve. Furthermore, a bristle is easily disentangled upon development, and the bristle behaves not as a bristle but as a single toner particle at a developing nip part between the developing sleeve and a photoconductive drum. Therefore, the toner consumption can be reduced.

If the remanent magnetization σr out of the magnetic properties of the toner is greater than 10.0 $Am^2/kg$, a magnetic cohesive force of toners that form a bristle increases to make it difficult to disentangle the bristle. Therefore, the toner is developed in an image area of a latent image on the photoconductive drum in a larger amount than is necessary to result in an increased toner consumption. On the contrary, if σr is smaller than 0.1 $Am^2/kg$, a force for pulling back the toner from the developing sleeve to the photoconductive drum weakens to result in deteriorated fog.

If the saturation magnetization σs is greater than 60 $Am^2/kg$, a bristle on the developing sleeve excessively enlarges to result in nonuniform charge of the toner, or the bristle is hardly disentangled, so that the toner consumption increases. If σs is smaller than 5 $Am^2/kg$, the toner hardly coats the developing sleeve uniformly to result in deteriorated developability.

The magnetic properties of the toner can be controlled by the magnetic properties and addition amount of a magnetic iron oxide to be used.

The Ti chelate compound to be used in the present invention preferably has a ligand selected from a diol, a dicarboxylic acid, and an oxycarboxylic acid. Of those, the ligand is particularly preferably any one of an aliphatic diol, a dicarboxylic acid, and an oxycarboxylic acid. An aliphatic ligand is preferable from the viewpoints of the reduction in a reaction time and the ease of temperature control because the aliphatic ligand has higher catalytic activity than that of an aromatic ligand.

Specific examples of the ligand to be used for the Ti chelate compound include: diols such as 1,2-ethanediol, 1,2-propanediol, and 1,3-propanediol; dicarboxylic acids such as oxalic acid, malonic acid, succinic acid, glutaric acid, adipic acid, and maleic acid; and oxycarboxylic acids such as glycolic acid, lactic acid, hydroxy acrylic acid, α-oxybutyric acid, glyceric acid, tartronic acid, malic acid, tartaric acid, and citric acid.

In addition, the Ti chelate compound is preferably represented by any one of the following formulae (I) to (VIII) and hydrates thereof.

Formula (I)

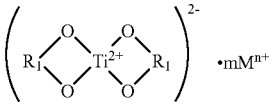

(In the formula (I), $R_1$ denotes an alkylene group or an alkenylene group having 2 to 10 carbon atoms and may have a substituent, M denotes a countercation, m denotes a cation number, n denotes a cation valence, n=2 when m=1, n=1 when m=2, and m denotes a hydrogen ion, an alkali metal ion, an ammonium ion, or an organic ammonium ion when n=1, and denotes an alkali earth metal ion when n=2.)

Formula (II)

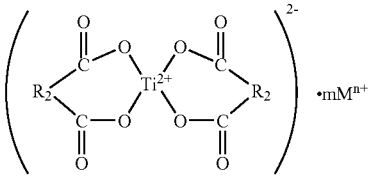

(In the formula (II), $R_2$ denotes an alkylene group or an alkenylene group having 1 to 10 carbon atoms and may have a substituent, M denotes a countercation, m denotes a cation number, n denotes a cation valence, n=2 when m=1, n=1 when m=2, and m denotes a hydrogen ion, an alkali metal ion, an ammonium ion, or an organic ammonium ion when n=1, and denotes an alkali earth metal ion when n=2.)

Formula (III)

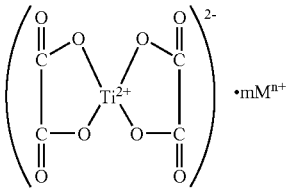

(In the formula (III), M denotes a countercation, m denotes a cation number, n denotes a cation valence, n=2 when m=1, n=1 when m=2, and M denotes a hydrogen ion, an alkali metal ion, an ammonium ion, or an organic ammonium ion when n=1, and denotes an alkali earth metal ion when n=2.)

Formula (IV)

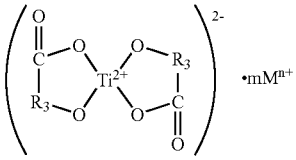

(In the formula (IV), $R_3$ denotes an alkylene group or an alkenylene group having 1 to 10 carbon atoms and may have a substituent, M denotes a countercation, m denotes a cation number, n denotes a cation valence, n=2 when m=1, n=1 when m=2, and M denotes a hydrogen ion, an alkali metal ion, an ammonium ion, or an organic ammonium ion when n=1, and denotes an alkali earth metal ion when n=2.)

Formula (V)

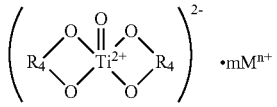

(In the formula (V), $R_4$ denotes an alkylene group or an alkenylene group having 2 to 10 carbon atoms and may have a substituent, M denotes a countercation, m denotes a cation number, n denotes a cation valence, n=2 when m=1, n=1 when m=2, and M denotes a hydrogen ion, an alkali metal ion, an ammonium ion, or an organic ammonium ion when n=1, and denotes an alkali earth metal ion when n=2.)

Formula (VI)

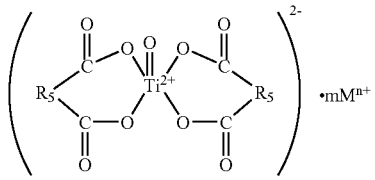

(In the formula (VI), $R_5$ denotes an alkylene group or an alkenylene group having 1 to 10 carbon atoms and may have a substituent, M denotes a countercation, m denotes a cation number, n denotes a cation valence, n=2 when m=1, n=1 when m=2, and M denotes a hydrogen ion, an alkali metal ion, an ammonium ion, or an organic ammonium ion when n=1, and denotes an alkali earth metal ion when n=2.)

Formula (VII)

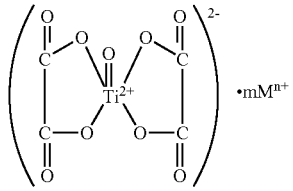

(In the formula (VII), M denotes a countercation, m denotes a cation number, n denotes a cation valence, n=2 when m=1, n=1 when m=2, and M denotes a hydrogen ion, an alkali metal ion, an ammonium ion, or an organic ammonium ion when n=1, and denotes an alkali earth metal ion when n=2.)

Formula (VIII)

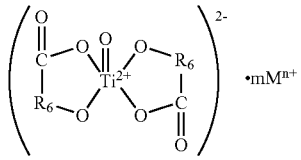

(In the formula (VIII), $R_6$ denotes an alkylene group or an alkenylene group having 1 to 10 carbon atoms and may have a substituent, M denotes a countercation, m denotes a cation number, n denotes a cation valence, n=2 when m=1, n=1 when m=2, and M denotes a hydrogen ion, an alkali metal ion, an ammonium ion, or an organic ammonium ion when n=1, and denotes an alkali earth metal ion when n=2.)

The Ti chelate compound represented by any one of the above formulae (II), (III), (VI), and (VII) and hydrates thereof is particularly preferable. This is because the compound increases the dispersibility of the magnetic iron oxide, so that an effect of improving environmental stability of developability of the toner or an effect of reducing the toner consumption is large.

The countercation M in any one of the formulae (I) to (VIII) is preferably an alkali metal. Examples of the alkali metal include lithium, sodium, potassium, rubidium, and cesium. Of those, lithium, sodium, and potassium are preferable. Sodium and potassium are particularly preferable.

The addition amount of the Ti chelate compound is 0.01% by mass or more and 2% by mass or less, preferably 0.05% by mass or more and 1% by mass or less with respect to the total amount of the polyester component. An addition amount of less than 0.01% by mass not only prolongs a reaction time at the time of polyester polymerization but also makes it difficult to obtain an effect of increasing the dispersibility of the magnetic iron oxide. An addition amount of more than 2% affects the charging property of the toner, so that a variation in charge amount tends to be large.

Each of those Ti chelate compounds may be used alone, or two or more kinds of those Ti chelate compounds may be used in combination. Alternatively, each of those Ti chelate compounds may be used in combination with a polymerization catalyst other than a Ti chelate compound. In particular, the use of two or more kinds of those Ti chelate compounds is preferable because it increases charging stability of the toner and also provides an effect of reducing the toner consumption.

Specific examples of the Ti chelate compounds (1) to (11) to be used in the present invention are shown below.

Ti Chelate Compound (1)

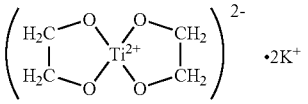

Ti Chelate Compound (2)

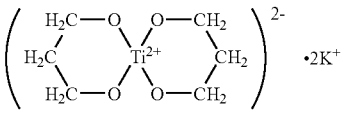

Ti Chelate Compound (3)

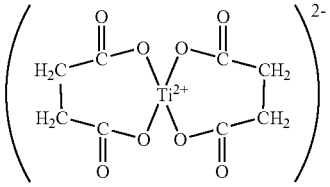

Ti Chelate Compound (4)

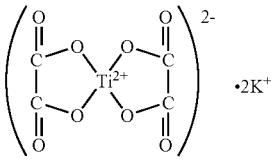

-continued

Ti Chelate Compound (5)

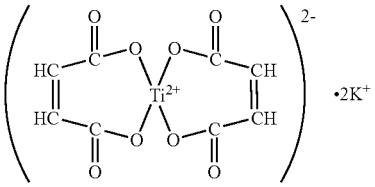

Ti Chelate Compoud (6)

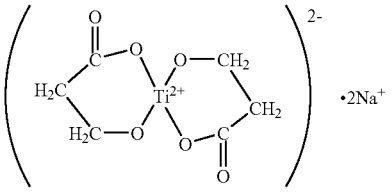

Ti Chelate Compound (7)

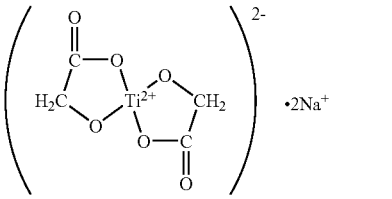

Ti Chelate Compound (8)

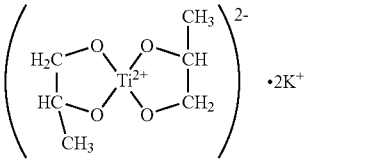

Ti Chelate Compound (9)

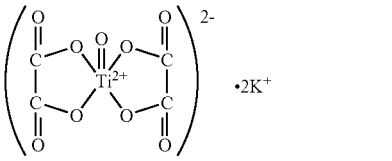

Ti Chelate Compound (10)

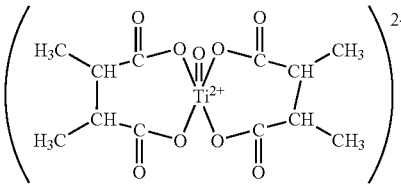

Ti Chelate Compound (11)

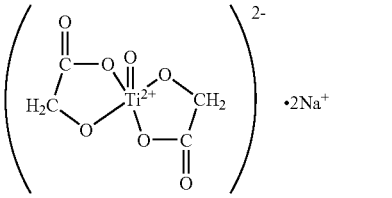

Furthermore, in the present invention, a promoter can be used in addition to the polymerization catalyst. For instance, a calcium compound such as calcium acetate, a magnesium compound such as magnesium acetate, or a zinc compound such as zinc acetate is used. Each of halides of alkali and/or alkali earth compounds can also be used as the promoter.

Specific examples of the halides include lithium chloride, potassium iodide, potassium fluoride, calcium chloride, and magnesium chloride.

The polyester component to be used in the present invention is prepared by condensation polymerization between a polyhydric alcohol and a polycarboxylic acid. Each polyester monomer component shown below is used for the polyester component to be used in the present invention.

Examples of dihydric alcohol components include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and bisphenols represented by the formula (A) and derivatives thereof; and diols represented by the formula (B).

Formula (A)

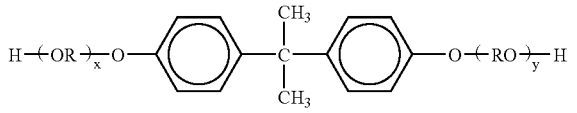

(In the formula, R denotes an ethylene group or a propylene group, x and y denote an integer of 0 or more, respectively, and an average value of x+y is 0 to 10.)

Formula (B)

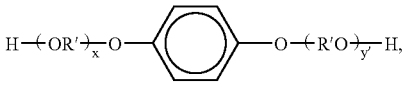

(In the formula, R' is one or two or more selected from $—CH_2CH_2—$, $—CH_2—CH(CH_3)—$, and $—CH_2—C(CH_3)_2—$, X' and y' each denote an integer of 0 or more, and an average value of x'+y' is 0 to 10.)

Examples of divalent acid components include dicarboxylic acids and derivatives thereof such as: benzenedicarboxylic acids or anhydrides thereof or lower alkyl esters thereof such as phthalic acid, terephthalic acid, isophthalic acid, and phthalic anhydride; alkyldicarboxylic acids such as succinic acid, adipic acid, sebacic acid, and azelaic acid, or anhydrides thereof or lower alkyl esters thereof; alkenyl succinic acids or alkyl succinic acids, such as n-dodecenylsuccinic acid and n-dodecylsuccinic acid, or anhydrides thereof or lower alkyl esters thereof; and unsaturated dicarboxylic acids such as fumaric acid, maleic acid, citraconic acid, and itaconic acid, or anhydrides thereof or lower alkyl esters thereof.

Further, it is preferable to use in combination an alcohol component with 3 or more hydroxyl groups and an acid component with a valence of 3 or more which act as cross-linked components.

Examples of a polyhydric alcohol component with 3 or more hydroxyl groups include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Particularly preferable examples of the polyhydric alcohol component with 3 or more hydroxyl groups include a compound having a structure containing oxyalkylene ether of a novolak type phenolic resin. A compound having a structure containing oxyalkylene ether of a novolak type phenolic resin is a reaction product of a novolak type phenolic resin and a compound having one epoxy ring in the molecule, and has 3 or more alcohol hydroxyl groups at its terminals.

As the novolak type phenolic resin, for example, as described in Encyclopedia of Polymer Science and Technology (Interscience Publishers) volume 10, page 1, section on phenolic resins, a resin can be given, which is manufactured by polycondensation of phenols and aldehydes using an inorganic acid such as hydrochloric acid, phosphoric acid, and sulfuric acid, or an organic acid such as para-toluenesulfonic acid and oxalic acid, or a metallic salt such as zinc acetate as a catalyst.

Examples of the phenols include phenol and a substituted phenol with one or more hydrocarbon groups each having 1 to 35 carbon atoms and/or halogen groups. Specific examples of the substituted phenol include cresol (any one of ortho-, meth- and para-), ethylphenol, nonylphenol, octylphenol, phenylphenol, styrenated phenol, isopropenylphenol, 3-chlorophenol, 3-bromophenol, 3,5-xylenol, 2,4-xylenol, 2,6-xylenol, 3,5-dichlorophenol, 2,4-dichlorophenol, 3-chlor-5-methylphenol, dichlorxylenol, dibromxylenol, 2,4,5-trichlorophenol, and 6-phenyl-2-chlorophenol. Two or more of the phenols may also be used in combination.

Of those, phenol and a substituted phenol with a hydrocarbon group are preferable, particularly, phenol, cresol, t-butylphenol, and nonylphenol are preferable. Phenol and cresol are preferable in terms of cost and offset resistance of a toner. The substituted phenol with a hydrocarbon group typified by t-butylphenol or nonylphenol is preferable since temperature dependency of charge amount of a toner is made small.

Examples of the aldehydes include formalin (formaldehyde solutions of various concentrations), paraformaldehyde, trioxane, and hexamethylenetetramine.

A number average molecular weight of a novolak type phenolic resin is normally within the range of 300 to 8,000, preferably 350 to 3,000, or more preferably 400 to 2,000. A number average nucleus number of phenols inside the novolak type phenolic resin is normally within the range of 3 to 60, preferably 3 to 20, or more preferably 4 to 15.

In addition, the novolak type phenolic resin has a softening point (JIS K 2531; ring and ball method) normally in the range of 40 to 180° C., preferably 40 to 150° C., or more preferably 50 to 130° C. A softening point below 40° C. causes blocking at normal temperature, thereby making it difficult to treat the resin. In addition, a softening point in excess of 180° C. is not preferable because gelation may occur during the manufacturing process of the polyester component.

Specific examples of the compound having one epoxy ring in the molecule include ethylene oxide (EO), 1,2-propylene oxide (PO), 1,2-butylene oxide, 2,3-butyleneoxide, styreneoxide, and epichlorohydrin. An aliphatic monohydric alcohol having 1 to 20 carbon atoms or glycidyl ether of monohydric phenol can be used as well. Of those, EO and/or PO are preferable.

A molar number of addition of the compound having one epoxy ring in the molecule is normally 1 to 30 moles, preferably 2 to 15 moles, or more preferably 2.5 to 10 moles with respect to 1 mole of the novolak type phenolic resin. In addition, an average molar number of addition of the compound having one epoxy ring in the molecule with respect to one phenolic hydroxyl group inside the novolak type phenolic resin is normally 0.1 to 10 moles, preferably 0.1 to 4 moles, or more preferably 0.2 to 2 moles.

The structure of a compound having a structure containing oxyalkylene ether of the novolak type phenolic resin particularly preferably used in the present invention is illustrated in the following formula (12).

Formula (12)

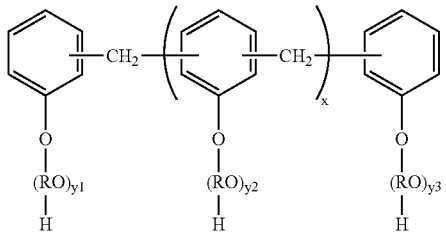

(In the formula, R denotes an ethylene group or a propylene group, x denotes an integer of 0 or more, and y1, y2, and y3 denote the same or different integer of 0 or more. At least one of y1, y2 and y3 denotes integer of 1 or more).

The compound having a structure containing oxyalkylene ether of the novolak type phenolic resin has a number average molecular weight normally in the range of 300 to 10,000, preferably 350 to 5,000, or more preferably 450 to 3,000. A number average molecular weight below 300 leads to insufficient offset resistance of the toner. A number average molecular weight in excess of 10,000 is not preferable because gelation may easily result during the manufacturing process of the polyester component.

The compound having a structure containing oxyalkylene ether of the novolak type phenolic resin has a hydroxyl group value (a total of an alcohol hydroxyl group and a phenol hydroxyl group) normally in the range of 10 to 550 mgKOH/g, preferably 50 to 500 mgKOH/g, or more preferably 100 to 450 mgKOH/g. In addition, among the hydroxyl group values, the phenol hydroxyl group value is normally in the range of 0 to 500 mgKOH/g, preferably 0 to 350 mgKOH/g, or more preferably 5 to 250 mgKOH/g.

The manufacturing method for a compound having a structure containing oxyalkylene ether of a novolak type phenolic resin is illustrated below. In the presence of a catalyst (basic catalyst or acidic catalyst) as required, a compound having one epoxy ring in the molecule is added to a novolak type phenolic resin to obtain a compound having a structure containing oxyalkylene ether of the novolak type phenolic resin. A reaction temperature is normally 20 to 250° C., or preferably 70 to 200° C. The addition reaction may also be performed under normal pressure, increased pressure, or reduced pressure. The addition reaction may also be carried out in the presence of at least one of a solvent such as xylene, or dimethylformamide, another dihydric alcohol, and another alcohol with 3 or more hydroxyl groups.

Further, examples of a polycarboxylic acid component with 3 or more carboxyl groups used in the present invention include polycarboxylic acids and derivatives thereof such as: pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, Empol trimer acid, and anhydrides thereof and lower alkyl esters thereof; and tetracarboxylic acids represented by the following formula (C), and anhydrides thereof and lower alkyl esters thereof. Of those, 1,2,4-benzenetricarboxylic acid, 1,2,5-benzenetricarboxylic acid, anhydrides thereof, and lower alkyl esters thereof are preferable.

Formula (C)

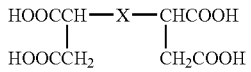

(In the formula, X denotes an alkylene group or an alkenylene group having 5 to 30 carbon atoms and having one or more side chain with 3 or more carbon atoms.)

A proportion of an alcohol component used in the present invention is 40 to 60 mol %, or preferably 45 to 55 mol %. Also, an acid component proportion is 60 to 40 mol %, or preferably 55 to 45 mol %. A proportion of a polyvalent component with a valence of 3 or more is preferably 5 to 60 mol % of the total composition.

The polyester component is obtained by condensation polymerization which is generally well-known. A polymerization reaction of a polyester component is normally performed under a temperature condition of 150 to 300° C., preferably about 170 to 280° C. in the presence of a Ti chelate compound represented by any one of the above formulae (I) to (VIII) as a catalyst. Also, the reaction can be carried out under normal pressure, reduced pressure, or increased pressure. The reaction is desirably carried out by reducing a reaction system pressure to lower than 200 mmHg, preferably lower than 25 mmHg, or more preferably lower than 10 mmHg after a predetermined rate of reaction is achieved (for instance, about 30 to 90%).

The polyester component of the present invention can be obtained by stopping the reaction when the properties (for instance, an acid value and a softening point) of a reaction product have reached predetermined values or when the agitation torque or agitation power of a reactor has reached a predetermined value.

The toner of the present invention may contain a vinyl polymer component. Examples of vinyl monomers constituting the vinyl polymer component include: styrene; styrene derivatives such as o-methylstyrene, m-methylstyrene, p-methylstyrene, p-phenylstyrene, p-ethylstyrene, 2,4-dimethylstyrene, p-butylstyrene, p-tert-tributylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; unsaturated monoolefins such as ethylene, propylene, butylene, and isobutylene; unsaturated polyenes such as butadiene and isoprene; vinyl halides such as vinyl chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylate or methacrylate derivatives such as acrylonitrile, methacrylonitrile, and acrylamide.

Further, examples of the vinyl monomers include: α,β-unsaturated acids such as acrylic acid, methacrylic acid, crotonic acid, and cinnamic acid; anhydrides of α,β-unsaturated acids such as crotonic anhydride and cinnamic anhydride; anhydrides of the α,β-unsaturated acids and lower fatty acids; and monomers having carboxyl groups such as alkenylmalonic acid, alkenylglutaric acid, alkenyladipic acid, and monoesters thereof.

Further, examples of the vinyl monomers include: acrylates or methacrylates such as 2-hydroxyethyl acrylate, 2-hydroxyethyl methacrylate, and 2-hydroxypropyl methacrylate; and monomers having hydroxy groups such as 4-(1-hydroxy-1-methylbutyl)styrene and 4-(1-hydroxy-1-methylhexyl)styrene.

Further, examples of the vinyl monomers include: unsaturated dicarboxylic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester, and mesaconic acid methyl half ester; unsaturated dicarboxylic acid diesters such as dimethyl maleate and dimethyl fumarate; unsaturated dicarboxylic acids such as maleic acid, citraconic acid, itaconic acid, alkenylsuccinic acid, fumaric acid, and mesaconic acid; unsaturated dicarboxylic acid anhydrides such as maleic anhydride, citraconic anhydride, itaconic anhydride, and alkenylsuccinic anhydride. However, when calculating a ratio of the polyester monomer component with respect to the total monomer components used for producing the binder resin used in the present invention, the above unsaturated dicarboxylic acid compounds are calculated as the polyester monomer component.

Further, the vinyl polymer component of the present invention may be a polymer crosslinked with crosslinking monomers exemplified below, as required.

Examples of aromatic divinyl compounds include divinylbenzene and divinlynaphthalene. Examples of diacrylate compounds bonded with an alkyl chain include ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by replacing the "acrylate" of each of the compounds with "methacrylate".

Further, examples of diacrylate compounds bonded with an alkyl chain containing an ether bond include diethylene glycol diacrylate, triethylene glycol diacrylate, tetraethylene glycol diacrylate, polyethylene glycol #400 diacrylate, polyethylene glycol #600 diacrylate, dipropyleneglycoldiacrylate, and those obtained by replacing the "acrylate" of each of the compounds with "methacrylate".

Further, examples of diacrylate compounds bonded with a chain containing an aromatic group and an ether bond include: polyoxyethylene(2)-2,2-bis(4-hydroxydiphenyl) propane diacrylate, polyoxyethylene(4)-2,2-bis(4-hydroxyphenyl)propane diacrylate, and those obtained by replacing the "acrylate" of each of the compounds with "methacrylate"; and polyester diacrylate compounds (for example, trade name MANDA, available from Nippon Kayaku Co., Ltd.).

Examples of polyfunctional crosslinking agents include: pentaerythritol triacrylate, trimethylolethane triacrylate, trimethylolpropane triacrylate, tetramethylolmethane tetraacrylate, oligoester acrylate, and those obtained by replacing the "acrylate" of each of the compounds with "methacrylate"; and triallyl cyanurate and triallyl trimellitate.

These crosslinking agents are used in an amount of preferably 0.01 to 10.0 parts by mass, and more preferably 0.03 to 5 parts by mass with respect to 100 parts by mass of other vinyl monomer components.

Examples of polymerization initiators used for producing the vinyl polymer component include: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis (1-cyclohexanecarbonitrile), 2-(carbamoylazo)isobutyronitrile, 2,2'-azobis(2,4,4-trimethylpentane), 2-phenylazo-2,4-dimethyl-4-methoxyvaleronitrile, and 2,2'-azobis(2-methylpropane); ketone peroxides such as methyl ethyl ketone peroxide, acetylacetone peroxide, and cyclohexanone peroxide; and 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α,α'-bis(t-butylperoxydiisopropyl)benzene, isobutyl peroxide, octanoyl peroxide, decanoyl peroxide, lauroyl peroxide, 3,5,5-trimethylhexanoyl peroxide, benzoyl peroxide, diisopropyl peroxydicarbonate, di-2-ethylhexyl peroxydicarbonate, di-n-propyl peroxydicarbonate, di-2-ethoxyethyl peroxydicarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

As the polymerization initiator used for producing the vinyl polymer component of the present invention, a polyfunctional polymerization initiator exemplified below may be used alone or in combination with monofunctional polymerization initiators.

Specific examples of the polyfunctional polymerization initiator having a polyfunctional structure include: polyfunctional polymerization initiators having two or more functional groups with polymerization initiating function such as peroxide groups within one molecule such as 1,1-di-t-butylperoxy-3,3,3-trimethylcyclohexane, 1,3-bis(t-butylperoxyisopropyl)benzene, 2,5-dimethyl-2,5(t-butylperoxy)hexane, 2,5-dimethyl-2,5-di(t-butylperoxy)hexane, tris(t-butylperoxy)triazine, 1,1-di-t-butylperoxycyclohexane, 2,2-di-t-butylperoxybutane, 4,4-di-t-butylperoxyvaleric acid-n-butyl ester, di-t-butylperoxyhexahydroterephthalate, di-t-butylperoxyazelate, di-t-butylperoxytrimethyladipate, 2,2-bis-(4,4-di-t-butylperoxycyclohexyl)propane, and 2,2-t-butylperoxyoctane; and polyfunctional polymerization initiators having both functional groups with polymerization initiating function such as peroxide groups and polymerizable unsaturated groups within one molecule such as diallylperoxydicarbonate, tributylperoxymaleic acid, t-butylperoxyallylcarbonate, and t-butylperoxyisopropylfumarate.

Of those, examples of more preferable polyfunctional polymerization initiators include 1,1-di-t-butylperoxy-3,3,5-trimethylcyclohexane, 1,1-di-t-butylperoxycyclohexane, di-t-butylperoxyhexahydroterephthalate, di-t-butylperoxyazelate and 2,2-bis-(4,4-di-t-butylperoxycyclohexyl)propane, and t-butylperoxyallylcarbonate.

Examples of preferable magnetic iron oxides used in the present invention include: magnetic iron oxides containing different elements such as magnetite, maghemite, and ferrite; and mixtures thereof.

Of those, the magnetic iron oxide preferably contains at least one element selected from the group consisting of lithium, beryllium, boron, magnesium, aluminum, silicon, phosphorus, germanium, titanium, zirconium, tin, lead, zinc, calcium, barium, scandium, vanadium, chromium, manganese, cobalt, copper, nickel, gallium, cadmium; indium, silver, palladium, gold, mercury, platinum, tungsten, molybdenum, niobium, osmium, strontium, yttrium, technetium, ruthenium, rhodium, and bismuth.

The magnetic iron oxide used in the present invention particularly preferably contains an Si element in an amount of 0.1 to 2.0% by mass with respect to the magnetic iron oxides.

The magnetic iron oxide containing an Si element exhibits a well-balanced level of exposure to a surface of the toner particles. The charge amount of the toner can be maintained high regardless of the environment, thereby preferably suppressing a decrease in image density in a high temperature and high humidity environment and a fog in a low temperature and low humidity environment at a higher level.

The preferable magnetic iron oxide used in the present invention has magnetic properties measured in a magnetic field of 795.8 kA/m such as: saturation magnetization of 10 to 200 $Am^2/kg$, and more preferably 70 to 100 $Am^2/kg$; remanent magnetization of 1 to 100 $Am^2/kg$, and more preferably 2 to 20 $Am^2/kg$; and antimagnetic force of 1 to 30 kA/m, and more preferably 2 to 15 kA/m.

The magnetic iron oxide according to the present invention may be treated with surface treatment agents such as a silane coupling agent, a titanium coupling agent, titanate, aminosilane, and an organic silicon compound.

A method for measuring various physical properties according to the present invention will be described below in detail.

(Determination of Amount of Metal Elements in the Magnetic Iron Oxide)

According to the present invention, contents of metal elements in the magnetic iron oxide (with respect to the magnetic iron oxide) except iron can be determined through the following method. For example, about 3 L of deionized water is poured into a 5 L beaker and is warmed to 45 to 50° C. using a water bath. About 25 g of the magnetic iron oxide in a slurry prepared by mixing with about 400 ml of deionized water is added to the 5 L beaker together with the deionized water while washing with about 300 ml of deionized water.

Next, a reagent-grade hydrochloric acid or a mixed acid of hydrochloric acid and hydrofluoric acid is added to the mixture while maintaining a temperature of about 50° C. and a stirring speed of about 200 rpm to begin dissolution. At this time, concentration of an aqueous hydrochloric acid solution is about 3 mol/L. About 200 ml of the mixture is taken as a sample when everything dissolves and the mixture becomes clear. Then, the amount of an iron element and the metal elements except the iron element is determined through Inductively Coupled Plasma Atomic Emission Spectrometry (ICP).

The contents of the metal elements except the iron element with respect to the magnetic iron oxide are calculated according to the following equation (1).

$$\text{Contents of the metal elements with respect to the magnetic iron oxide (mass \%)} = ((c \times d)/(e \times 1000)) \times 100 \quad \text{Equation (1)}$$

(wherein, c: metal element concentration in the sample (mg/l), d: amount of the sample (1), and e: mass of the magnetic iron oxide (g))

(Magnetic Properties of the Magnetic Toner and the Magnetic Iron Oxide)

The magnetic properties can be measured using "oscillation-type magnetometer" (VSM-3S-15, manufactured by TOEI INDUSTRY CO., LTD. ) in an external magnetic field of 795.8 kA/m.

The toner of the present invention may contain a colorant. The colorant that may be used in the toner of the present invention includes an arbitrary, appropriate pigment or dye. Examples of the pigment include: carbon black, aniline black, acetylene black, naphthol yellow, Hansa yellow, rhodamine lake, alizarin lake, colcothar, phthalocyanine blue, and indanthrene blue. Those colorants are used in a necessary and sufficient amount for maintaining optical density of the fixed image. The colorant is added in an amount of 0.1 to 20 parts by mass, and preferably 0.2 to 10 parts by mass with respect to 100 parts by mass of the resin.

The dye can be used for the same purpose. Examples of the dye include an azo dye, an anthraquinone dye, a xanthene dye, and a methine dye. The dye is added in an amount of 0.1 to 20 parts by mass, and preferably 0.3 to 10 parts by mass with respect to 100 parts by mass of the resin.

According to the present invention, use of a metal compound of aromatic hydroxycarboxylic acid represented by the following general formula (13) is preferable for speeding up charging and improving environmental stability of the developability.

Formula (13)

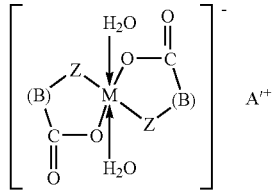

(wherein, M represents a coordinating central metal such as Cr, Co, Ni, Mn, Fe, Ti, Zr, Zn, Si, B, or Al. (B) represents;

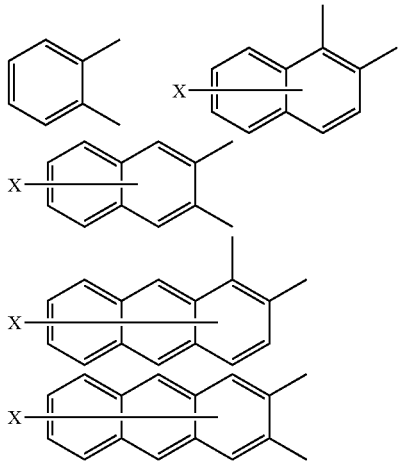

(may contain a substituent such as an alkyl group) (wherein, X represents a hydrogen atom, a halogen atom, or a nitro group); and

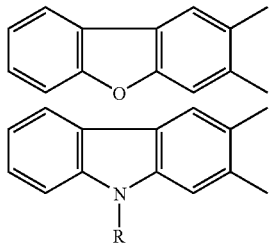

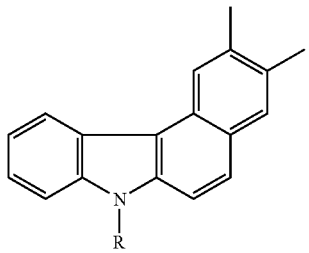

wherein, R represents a hydrogen atom, an alkyl group having 1 to 18 carbon atoms, or an alkenyl group having 2 to 18 carbon atoms).

$A'^{+}$ represents hydrogen, a sodium ion, a potassium ion, an ammonium ion, or an aliphatic ammonium ion. Z represents —O— or —C(=O)—O—.)

Next, specific examples of the metal compound of droxycarboxylic acid will be represented as follows.

Al salicylic compound (14)

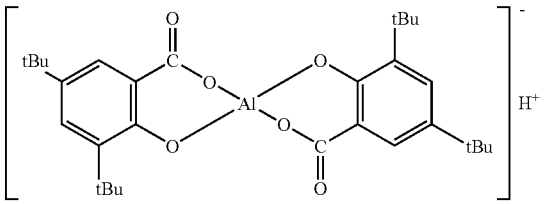

-continued

Zn salicylic compound (15)

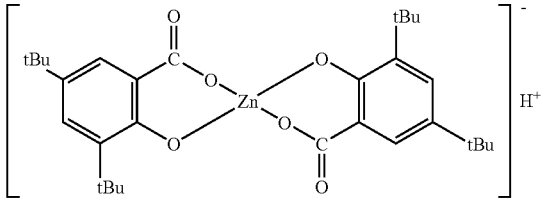

Cr salicylic compound (16)

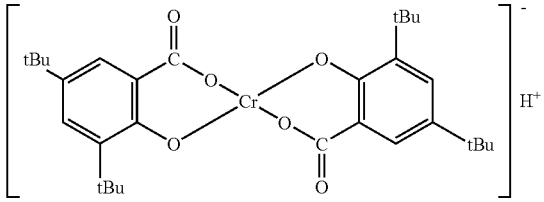

Zr salicylic compound (17)

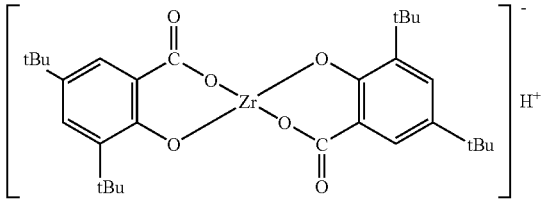

Of those, a compound having Al for a central metal is preferable for providing a higher charge amount.

It is also a preferable mode for the toner of the present invention to contain a monoazo iron compound as a charge control agent for increasing the toner charge and enhancing the stability of the charge.

The monoazo iron compound represented by the following general formula (18) is particularly preferable for imparting high charge amount with stability.

Formula (18)

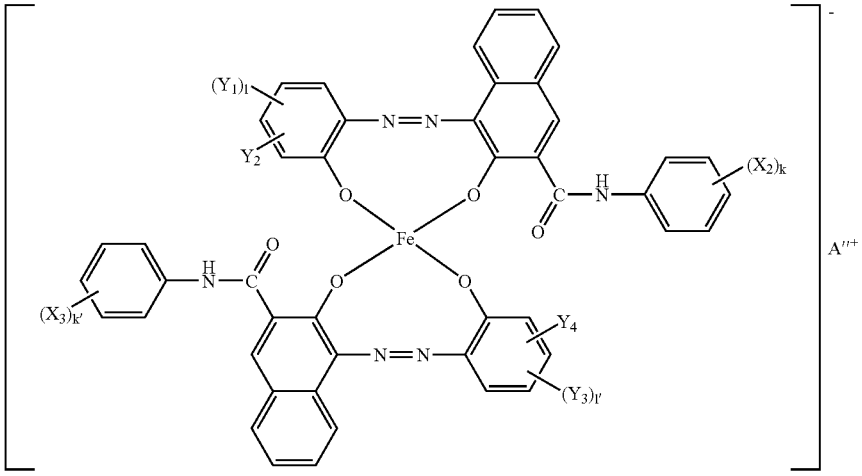

(wherein, $X_2$ and $X_3$ each represent a hydrogen atom, a lower alkyl group, a lower alkoxy group, a nitro group, or a halogen atom, and k and k' each represent an integer of 1 to 3. $Y_1$ and $Y_3$ each represent a hydrogen atom, an alkyl group having 1 to 18 carbon atoms, an alkenyl group having 2 to 18 carbon atoms, a sulfonamide group, a mesyl group, a sulfonic group, a carboxylate group, a hydroxy group, an alkoxy group having 1 to 18 carbon atoms, an acetylamino group, a benzoyl group, an amino group, or a halogen atom. 1 and l' each represent an integer of 1 to 3, and $Y_2$ and $Y_4$ each represent a hydrogen atom or a nitro group. The above $X_2$ and $X_3$, k and k', $Y_1$ and $Y_3$, 1 and l', and $Y_2$ and $Y_4$ may be the same or different from each other. $A''^{+}$ represents an ammonium ion, a sodium ion, a potassium ion, a hydrogen ion, or a mixed ion thereof, and preferably contains 75 to 98 mol % of the ammonium ion.)

Next, specific examples of the monoazo iron compound are represented below.

Monoazo iron compound (1)

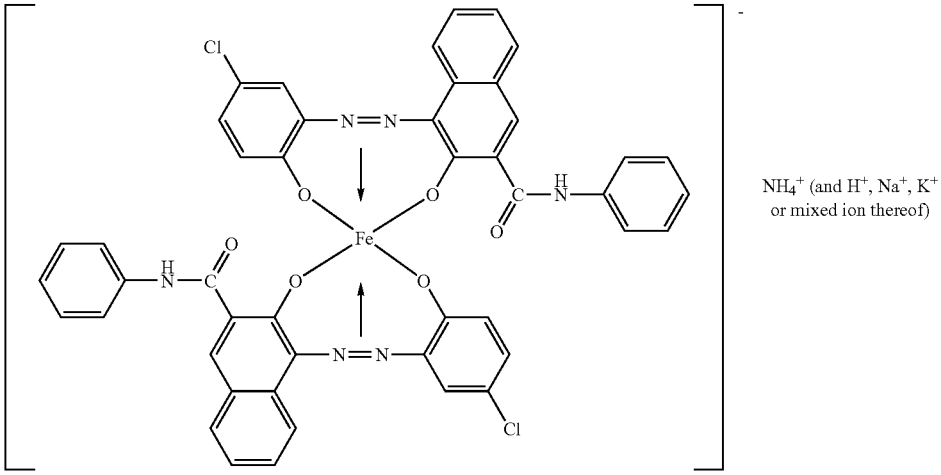

Monoazo iron compound (2)

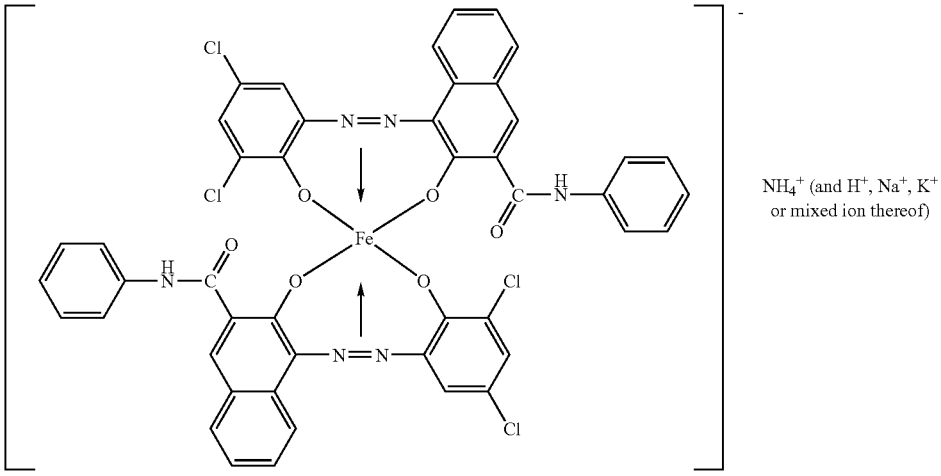

-continued
Monoazo iron compound (3)
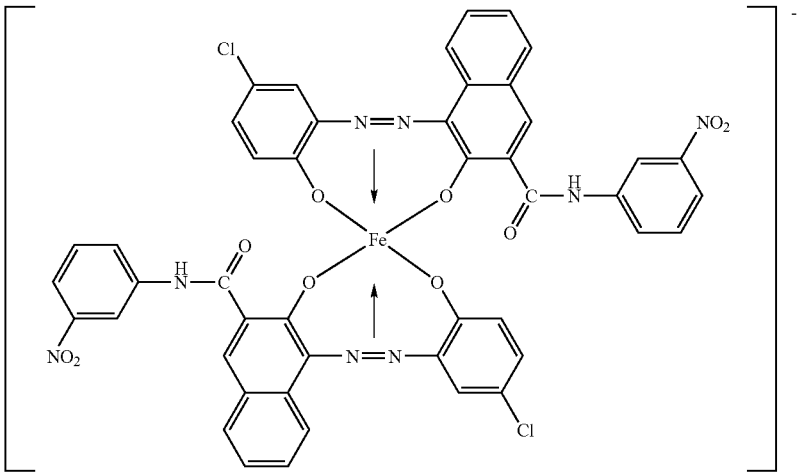
$NH_4^+$ (and $H^+$, $Na^+$, $K^+$ or mixed ion thereof)
Monoazo iron compound (4)
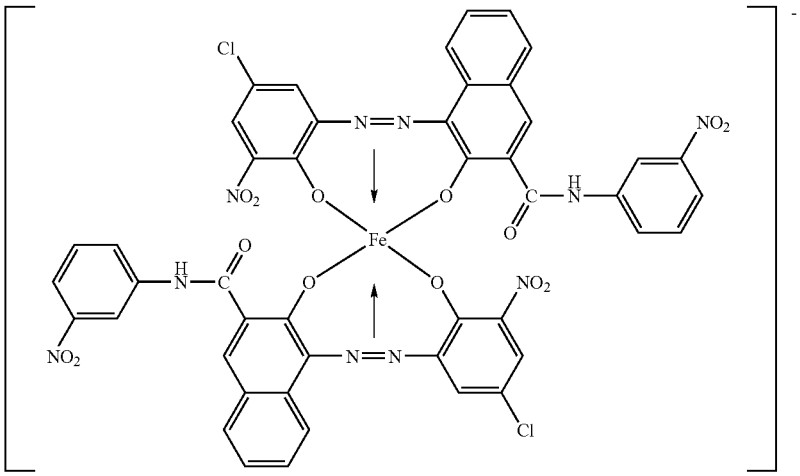
$NH_4^+$ (and $H^+$, $Na^+$, $K^+$ or mixed ion thereof)
Monoazo iron compound (5)
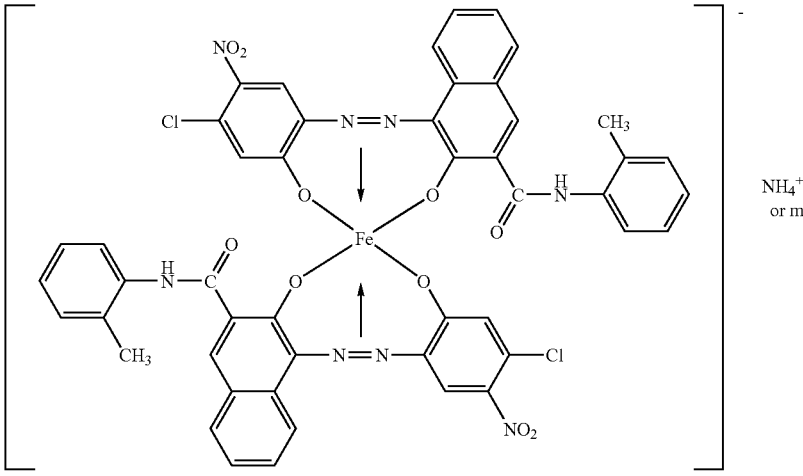
$NH_4^+$ (and $H^+$, $Na^+$, $K^+$ or mixed ion thereof)

-continued

Monoazo iron compound (6)

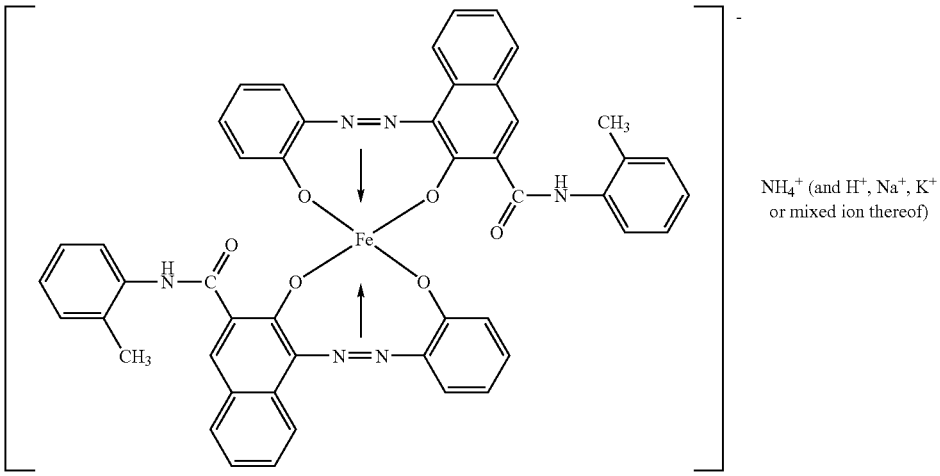

Monoazo iron compound (7)

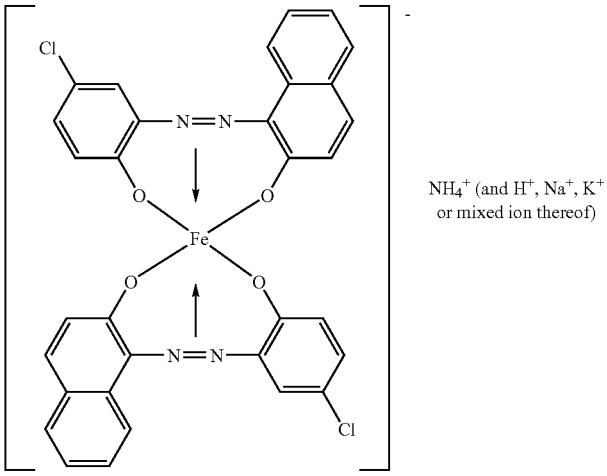

Of those, a compound represented as the monoazo iron compound (1) is preferable for reducing toner consumption.

Those monoazo iron compounds are used in the range of 0.1 to 10 parts by mass, and more preferably 0.1 to 5 parts by mass with respect to 100 parts by mass of the binder resin.

Particularly in the present invention, use of an Al hydroxycarboxylic compound and a monoazo iron compound together preferably results in a significant increase of the charge amount of the toner and an improvement in the environmental stability of the developability in the case of combining the above two compounds with the polyester component polymerized using a Ti chelate compound.

The magnetic toner of the present invention preferably has an average circularity of the toner particles, which have a equivalent circle diameter of 3 μm to 400 μm, of preferably 0.930 to less than 0.970, more preferably 0.935 to less than 0.970, measured using a flow-type particle image analyzer for achieving less toner consumption.

Controlling the magnetic properties and the circularity of the magnetic toner using a binder resin with a polyester component polymerized using a Ti chelate as a catalyst, in particular, allows a very sharp distribution of the charge amount or the magnetic properties of the toner particles, thus satisfying the requirements of less toner consumption and high image density at high level.

The toner particles of a spherical magnetic toner will theoretically not have magnetic isotropy if the magnetic iron oxide is dispersed uniformly. Therefore, magnetic cohesion of the toner particles does not occur, thus enabling a development of the toner particles dispersed as individual particles, rather than a development of a bristle. As a result, a bare minimum of the toner is developed on the photoconductive drum, and the toner consumption is reduced. With low circularity, the toner particles are uneven. A concave portion or a convex portion of the toner particles partially has a localized magnetic direction, and magnetic cohesion force of the toner particles becomes large. In addition, the bristle is hardly loosened during the development, thereby causing an increase of the toner consumption. Controlling the circularity reduces the unevenness of the toner particles and averages the magnetic force inside the toner particles, and the magnetic anisotropy becomes small. The magnetic cohesion force of the toner particles thus becomes small and the bristle is easily loosened, allowing a reduction of the toner consumption. If the average circularity is less than 0.930 for the toner particles having equivalent circle diameters of 3 μm to 400 μm measured using a flow-type particle image analyzer, the magnetic cohesion force is large, and the toner consumption easily increases. If the average circularity is 0.970 or more, controlling a coat of the toner on the developing sleeve becomes difficult. Therefore, the charge amount distribution of the toner becomes broad with an excess amount of the coat. The developability may degrade, and a fog may increase to increase the toner consumption.

The average circularity according to the present invention is adapted to simply express a particle shape in a quantitative manner. In the present invention, using a flow-type particle image analyzer ("FPIA-2100", manufactured by SYSMEX COPORATION) in an environment of 23° C. and 60% RH, a circularity of each of the particles, which have equivalent circle diameters of 0.60 μm to 400 μm, is determined according to the following equation (2). Further, a value determined by dividing the sum of measured circularity values of total particles having equivalent circle diameters of 3 μm to 400 μm, by the number of total particles is defined as an average circularity.

$$\text{Circularity } a = L_0/L \qquad \text{Equation (2)}$$

(wherein, $L_0$ represents a circumferential length of a circle having an area identical to that of a projected particle image, and L represents a circumferential length of the projected particle image processed at an image processing resolution of 512×512 (0.3 μm×0.3 μm pixel).)

The circularity used in the present invention is an index of a degree of unevenness of the toner particles. The circularity of 1.00 represents that the toner particles have a shape of a perfect sphere, and a small value of circularity represents a complex surface shape of the toner.

Here, the analyzer "FPIA-2100" used in the present invention calculates the average circularity by the following method. That is, "FPIA-2100" measured the circularity, then each particle is divided into 61 classes in the circularity range of 0.4 to 1.0 according to the measured circularity for calculation of the average circularity. The average circularity is determined using a central value of circularity of each class and the frequency of particles of the class. However, the error range of the average circularity value thus calculated by the above calculation method and the average circularity value obtained according to an equation using the sum of circularity values of each of the particles is extremely few, substantially negligible. Therefore, for data processing such as shortening the calculation time and simplifying the arithmetic expressions, using the conception of the equation using the sum of the above circularity values of each of the particles, a partially modified calculation method may be used. Further, the analyzer "FPIA-2100" used in the present invention has an increased measuring accuracy for of the toner shape compared to "FPIA1000" conventionally used for calculating the toner shape, through thinning of a sheathed flow (7 μm to 4 μm), enhancing of the magnification of processed particle images, and enhancing of the processing resolution of images taken in (256×256 to 512×512), thereby achieving more reliable trapping of fine particles. Therefore, when the particle shape and the particle size distribution must be more accurately measured as in the present invention, FPIA-2100 is useful for providing more accurate information relating to the particle shape and the particle size distribution.

As a specific method for measuring the circularity, 0.1 to 0.5 ml of a surfactant, preferably alkylbenzenesulfonate, as a dispersant is added to 200 to 300 ml of water with impurities removed from a reaction vessel in advance. To this solution, about 0.1 to 0.5 g of a measuring sample is further added. The resultant suspension containing the dispersed sample is subjected to dispersion using an ultrasonic generator for 2 minutes. The circularity distribution of the particles is measured by adjusting the dispersion concentration to 2,000 to 10,000 particles/μl. The following device is used as the ultrasonic generator, for example, under the following dispersion condition. UH-150 (manufactured by SMT Co., Ltd.)

Output Level: 5

Constant Mode

The following describes an outline of the measurement. The sample dispersion passes through a passage, which is expanded along a flow direction, of a flat flow cell of which thickness is about 200 μm. A strobe and a CCD camera are installed to position mutually opposite to the flow cell to form an optical path passing across the thickness of the flow cell. The strobe is irradiated to the flowing sample dispersion at an interval of 1/30 seconds to provide an image of the particles flowing through the flow cell. As a result, each of the particles is projected as a two-dimensional image having a fixed area parallel to the flow cell. A diameter of a circle having the same area with an area of the two-dimensional image of each of the particles is calculated as the equivalent circle diameter. The circularity of each of the particles is calculated from the projected image area of the two-dimensional image of each of the particles and the circumferential length of the projected image using the above circularity equation.

Next, a method for producing the toner particles through a surface modification step will be described as a preferable method for providing the toner particles of the present invention. A surface modification device used in the surface modification step and a method for producing the toner particles using the surface modification device will be specifically described below with reference to the drawings.

Figure 2:
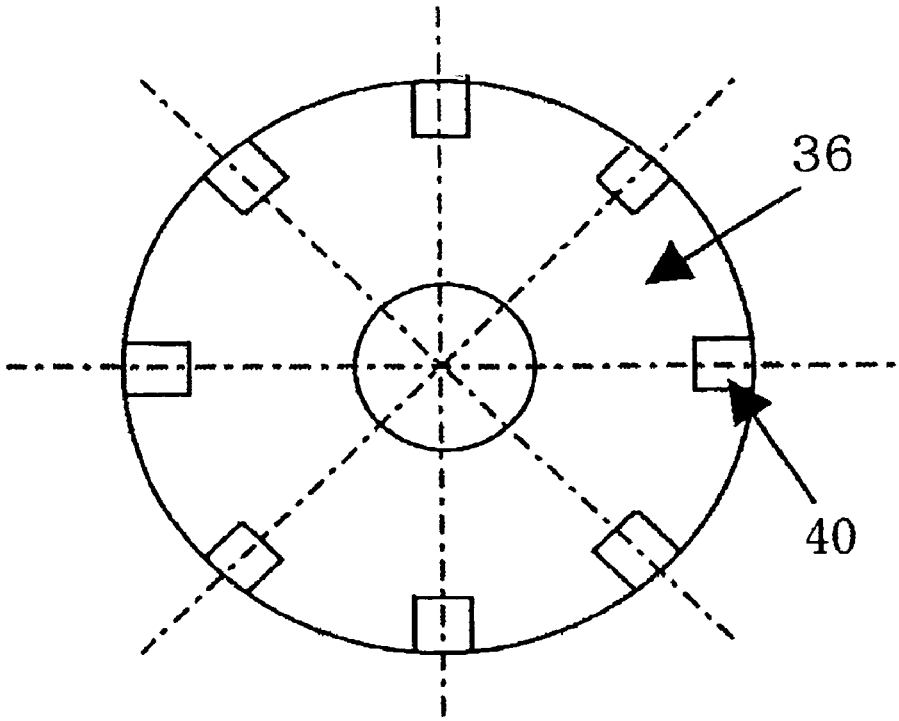
FIG. 2 is a schematic view showing an example of a top view of a dispersion rotor shown in FIG. 1.

FIG. 1 shows an example of the surface modification device used in the present invention, and FIG. 2 shows an example of a top view of a rotor in FIG. 1 which rotates at high speed.

The surface modification device shown in FIG. 1 possesses: a casing; a jacket (not shown) which allows a cooling water or an antifreeze to pass therethrough; a dispersion rotor 36 which is a surface modification means and a disc rotor, fixed at a central rotation axis inside the casing, rotating at high speed and having plural square discs or cylindrical pins 40 on an upper surface; a liner 34 provided with a plurality of grooves in its surface and located around an outer periphery of the dispersion rotor 36 with a prescribed distance maintained to the dispersion rotor 36 (the liner may be without grooves); a classification rotor 31 which is a means for classifying surface-modified toner ingredients to a prescribed particle size; a cool air introduction port 35 for introducing cool air; a toner ingredient supply port 33 for introducing toner ingredients to be treated; a discharge valve 38 arranged to be capable of opening and closing to allow adjustment of the surface modification time; a powder discharge port 37 for discharging the treated powders; and a cylindrical guide ring 39 as a guiding means, dividing the space surrounded by the classification rotor 31 as a classifying means, the dispersion rotor 36 as a surface modification means, and the liner 34 into a first space 41 for receiving the particles before being introduced to the classifying means and a second space 42 for introducing the particles, with fine particles removed by classifying means, to the surface modification means. A gap portion between the dispersion rotor 36 and the liner 34 refers to a surface modification zone, and a portion including the classification rotor 31 and the periphery portion of the rotor refers to a classification zone.

The classification rotor 31 may be placed horizontally or vertically as shown in FIG. 1. Further, the number of the classification rotors 31 may be single as shown in FIG. 1 or plural.

In the surface modification device constructed as described above, toner ingredient particles introduced from the toner ingredient supply port 33 with the discharge valve 38 closed are sucked in using a blower (not shown) and then classified by the classification rotor 31.

At this time, classified fine powders of the prescribed particle size or smaller are continuously discharged and removed outside the device 32. The coarse powders of the prescribed particle size or larger are guided to the surface modification zone along the inner periphery (second space 42) of the guide ring 39 through centrifugation while being carried by a circulating flow generated by the dispersion rotor 36. The toner ingredients guided to the surface modification zone receive mechanical impact force between the dispersion rotor 36 and the liner 34, and are subjected to surface modification treatment. The surface-modified particles are guided to the classification zone along the outer periphery of the guide ring 39 (first space 41) while being carried by cool air passing through the device. The fine powders are discharged outside the device again by the classification rotor 31. The coarse powders are carried by the circulating flow to be returned to the surface modification zone again to be repeatedly subjected to surface modification. After a certain time period, the surface-modified particles are collected from the discharge port 37 by opening the discharge valve 38.

The present invention has such a feature that the surface modification of the toner particles can be conducted simultaneously with the removal of the fine powder component during the toner particle surface modification step. Accordingly, toner particles having desired circularity, desired average surface roughness, and a desired amount of ultrafine particles can be effectively provided without the ultrafine particles adhering to the toner particle surface. If the fine powders cannot be removed simultaneously with the surface modification, an amount of the ultrafine particles in the surface-modified toner particles becomes large. In addition, the ultrafine particle component adheres to the toner particle surface having a suitable particle size owing to mechanical and thermal influences. As a result, protrusions caused by the adhered fine powder component form on the surface of the toner particles, thus not providing the toner particles having desired circularity and desired average surface roughness.

As a result of studies by the inventors of the present invention, surface modification time, or cycle time, through the surface modification device is preferably 5 to 180 seconds, more preferably 15 to 120 seconds. If the surface modification time is less than 5 seconds, the surface-modified toner particles may not be sufficiently obtained because of shortage of modification time. Further, if the modification time exceeds 180 seconds, the surface modification time is too long. Such an excess surface modification time may result in fusion inside the device due to heat produced during the surface modification and degrading of throughput.

Further, temperature T1 of cool air introduced inside the surface modification device is preferably 5° C. or less according to the method for producing the toner particles of the present invention. Setting the temperature T1 of the cool air introduced inside the surface modification device to 5° C. or less, more preferably 0° C. or less, further more preferably −5° C. or less enables prevention of fusion inside the device by heat generated during the surface modification. If the temperature T1 of cool air introduced inside the surface modification device exceeds 5° C., fusion may occur inside the device by heat generated during surface modification.

The cool air introduced inside the surface modification device is preferably dehumidified from a viewpoint of preventing dew drop inside the device. Any known dehumidifier can be used. A dew-point temperature of the cool air introduced is preferably −15° C. or less, and more preferably −20° C. or less.

Further, inside of the surface modification device possesses a jacket for cooling inside the device according to the method for producing the toner particles of the present invention. The surface modification treatment is preferably conducted while passing a coolant (preferably a cooling water, more preferably an antifreeze such as ethylene glycol) through the jacket. Cooling inside the device using the jacket allows prevention of fusion inside the device by heat during the surface modification of the toner particles.

The temperature of the coolant passing through the jacket of the surface modification device is preferably 5° C. or less. Setting the temperature of the coolant passing through the jacket of the surface modification device to preferably 5° C. or less, more preferably 0° C. or less, further more preferably −5° C. or less allows prevention of fusion inside the device by heat during surface modification. If the temperature of the coolant introduced inside the jacket exceeds 5° C., fusion may occur inside the device by heat generated during the surface modification.

Further, temperature T2 of a rear of the classification rotor inside the surface modification device is preferably 60° C. or less. Setting the temperature T2 of the rear of the classification rotor inside the surface modification device to 60° C. or less, and preferably 50° C. or less allows prevention of fusion inside the device by heat generated during the surface modification. If the temperature T2 of the rear of the classification rotor inside the surface modification device exceeds 60° C., fusion may occur inside the device by heat generated during surface modification because the surface modification zone will be subjected to a temperature above 60° C.

Further, a minimum gap between the dispersion rotor and the liner inside the surface modification device is preferably 0.5 mm to 15.0 mm, and more preferably 1.0 mm to 10.0 mm according to the method for producing the toner particles of the present invention. Further, a rotating peripheral speed of the dispersion rotor is preferably 75 m/sec to 200 m/sec, and more preferably 85 m/sec to 180 m/sec. Further, a minimum gap between an upper portion of the square discs or cylindrical pins located on the upper surface of the dispersion rotor inside the surface modification device and a lower portion of the cylindrical guide ring is preferably 2.0 mm to 50.0 mm, and more preferably 5.0 mm to 45.0 mm.

A pulverizing surface of the dispersion rotor and the liner inside the surface modification device is preferably subjected to abrasion resistance treatment from a viewpoint of toner particle productivity according to the present invention. A method for the abrasion resistance treatment is not limited in anyway. Further, a blade shape of the dispersion rotor and the liner inside the surface modification device is also not limited in any way.

A method for producing the toner particles of the present invention preferably includes removing a certain amount of fine powders and coarse powders from the toner ingredient particles pulverized close to a desired particle size in advance using an air sifter, and subjecting the toner particles to surface modification and removal of the ultrafine powder component through the surface modification device. Removal of the fine powders in advance results in satisfactory dispersion of the toner particles inside the surface modification device. The fine powder component in the toner particles, in particular, has a large specific area and has a relatively higher charge amount compared to other large toner particles. Therefore, the fine powder component is hardly separated from other toner particles, and the ultrafine powder component may not be adequately classified by the classification rotor. However, removing the fine powder component in the toner particles in advance allows easier dispersion of individual toner particles inside the surface modification device and adequate classification of the ultrafine powder component by the classification rotor, thus providing toner particles having a desired particle size distribution. The toner with the fine powders removed using the air sifter preferably has a cumulative value of a number average distribution of the toner particles having a particle diameter of less than 4 μm of 10% to less than 50%, preferably 15% to less than 45%, more preferably 15% to less than 40% in the particle diameter distribution measured using a COULTER-COUNTER method. The ultrafine powder component can be effectively removed using the surface modification device according to the present invention. Examples of the air sifter used in the present invention include "ELBOW JET" (manufactured by Nittetsu Mining Co., Ltd.).

Further, controlling the rpms, etc. of the dispersion rotor and the classification rotor inside the surface modification device according to the present invention enables control of the circularity and the average surface roughness of the toner particles to more appropriate values.

The toner of the present invention may contain a wax.

Various waxes maybe used for the wax of the present invention and examples thereof include: aliphatic hydrocarbon waxes such as low molecular weight polyethylene, low molecular weight propylene, a polyolefin copolymer, a polyolefin wax, a microcrystalline wax, a paraffin wax, and a Fischer-Tropsch wax; aliphatic hydrocarbon oxide waxes such as a polyethylene oxide wax; block copolymers of the aliphatic hydrocarbon waxes and the aliphatic hydrocarbon oxide waxes; vegetable waxes such as a candelila wax, a carnauba wax, a Japanese wax, and a jojoba wax; animal waxes such as beeswax, lanolin, and a spermaceti wax; mineral waxes such as ozokerite, ceresin, and petrolactam; waxes having aliphatic esters as a main component such as a montanoic acid ester wax and a castor wax; and aliphatic ester waxes of which a part of or a whole acidic component is removed, such as an deacidified carnauba wax.

Further examples of the wax include: straight-chain saturated fatty acids such as palmitic acid, stearic acid, montanic acid, and a long-chain alkyl carboxyl acid having a long-chain alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and an alkyl alcohol having a long-chain alkyl group; polyalcohols such as sorbitol; fatty amides such as linoleic amide, oleic amide, and lauric amide; saturated fatty bis amides such as methylene bis stearamide, ethylene bis capramide, ethylene bis lauramide, and hexamethylene bis stearamide; unsaturated fatty amides such as ethylene bis oleamide, hexamethylenebis oleamide, N,N'-dioleyl adipamide, and N,N'-dioleyl sebacamide; aromatic bis amides such as m-xylene bis stearamide and N-N'-distearyl isophthalamide; aliphatic metal salts, which are generally referred to as metallic soaps, such as calcium stearate, calcium laurate, zinc stearate, and magnesium stearate; graft waxes which are obtained by grafting aliphatic hydrocarbon waxes with vinyl monomers such as styrene and acrylate; partially esterified compounds of fatty acids and polyalcohols such as behenic monoglyceride; and methyl ester compounds having hydroxyl groups obtained by hydrogenation of vegetable oil.

Examples of the wax preferably used include: waxes having a sharper molecular weight distribution obtained through a press sweating process, a solvent method, a recrystallization method, a vacuum distillation method, a supercritical gas extraction method, or a melt crystallization method; low molecular weight solid fatty acids; low molecular weight solid alcohols; low molecular weight solid compounds; and other compounds with impurities removed.

Further, in the magnetic toner of the present invention, hydrophobic inorganic fine particles are preferably added to the magnetic toner particles as an external additive.

Examples of the hydrophobic inorganic fine particles used in the present invention include: oxides such as wet process silica, dry process silica, titanium oxide, alumina, zinc oxide, and tin oxide; multiple oxides such as strontium titanate, barium titanate, calcium titanate, strontium zirconate, and calcium zirconate; and carbonate compounds such as calcium carbonate and magnesium carbonate. However, the hydrophobic inorganic fine particles are preferably selected from the group consisting of silica, titanium oxide, alumina, and multiple oxides thereof for improving developability and fluidity.

The particularly preferable inorganic fine particles are silica fine particles formed through a vapor phase oxidation of a silicon halide, which is called a dry process silica or fumed silica. The formation of the above silica involves heat decomposition oxidation reaction in oxyhydrogen flame of a silicon tetrachloride gas, for examples, and a basic reaction formula is described below.

$$SiCl_4+2H_2+O_2 \rightarrow SiO_2+4HCl$$

Composite fine particles of silica and other metal oxides can also be obtained by using a silicon halide with other metal halides such as aluminum chloride and titanium chloride in the production step, and silica used in the present invention embraces those as well.

The hydrophobic inorganic fine particles used in the present invention are preferably subjected to hydrophobic treatment using 1 or more kinds of hydrophobic agents such as silicone varnish, silicone oil, various modified silicon oils, silane coupling agents, silane coupling agents having functional groups, other organic silicon compounds, and organic titanium compounds which react with or physically adsorb to the inorganic fine particles.

The hydrophobic inorganic fine particles are preferably treated with a silane compound or silicone oil, in particular, and of those, the inorganic fine particles are particularly preferably treated with both the silane compound and the silicone oil. That is, surface treating the inorganic fine particles using those two types of hydrophobic agents shifts hydrophobicity distribution to higher hydrophobicity, enables uniform treatment, and gives the inorganic fine particles excellent fluidity, uniform charge amount, and humidity resistance. Therefore, the toner can be provided with satisfactory developability, in particular, developability and durability stability in a high humidity environment.

Examples of the silane compound include: alkoxysilanes such as methoxysilane, ethoxysilane, and propoxysilane; halosilanes such as chlorosilane, bromosilane, and iodosilane; silazanes; hydrosilanes; alkylsilanes; arylsilanes; vinylsilanes; acrylsilanes; epoxysilanes; silyl compounds; siloxanes; silylureas; silylacetamides; and silane compounds having different substituents of those silane compounds together. Using those silane compounds provides fluidity, transferability, and charge stability. A plurality of those silane compounds may be used.

Specific examples of the silane compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing a hydroxyl group bonded to one Si within a unit located in a terminal. One kind of those silane compounds may be used independently, or two or more kinds thereof may be used as a mixture.

Examples of the silicone oil preferably used in the present invention include: reactive silicones such as amino-modified, epoxy-modified, carboxyl-modified, carbinol-modified, methacryl-modified, mercapto-modified, phenol-modified, and different functional groups-modified silicones; unreactive silicones such as polyether-modified, methylstyryl-modified, alkyl-modified, fatty acid-modified, alkoxy-modified, and fluorine-modified silicones; and straight silicones such as dimethyl silicone, methylphenyl silicone, diphenyl silicone, and methylhydrogen silicone.

Of those, the silicone oil containing an alkyl group, an aryl group, an alkyl group of which a part of or whole hydrogen atom is substituted with fluorine atoms, or hydrogen atom as a substituent, is preferable. Specific examples of the preferable silicone oil include dimethyl silicone oil, methylphenyl silicone oil, methylhydrogen silicone oil, and fluorine-modified silicone oil.

Those silicone oils have a viscosity at 25° C. of preferably 5 to 2,000 $mm^2/s$, more preferably 10 to 1,000 $mm^2/s$, and further more preferably 30 to 100 $mm^2/s$. If the viscosity is below 5 $mm^2/s$, sufficient hydrophobicity may not be obtained. If the viscosity is above 2,000 $mm^2/s$, the inorganic fine particles may not be treated uniformly, and aggregates are easily formed. Thus, sufficient fluidity may not be provided.

One or more kinds of those silicone oils are used as a mixture, in combination, or in multiple treatments. Further, the treatment using the silicone oils may be combined with the treatment using the silane compounds.

The inorganic fine particles can be treated with the silane compounds according to a known method including a dry process in which the inorganic fine particles formed into a cloud form using a stirrer or the like are reacted with a vaporized silane compound, and a wet process in which the inorganic fine particles dispersed in a solvent are reacted with a silane compound by dropping.

The amount of the silane compounds added for the treatment of the inorganic fine particles is 5 to 40 parts by mass, preferably 5 to 35 parts by mass, and more preferably 10 to 30 parts by mass with respect to 100 parts by mass of the base inorganic fine particles.

The amount of the silicone oil added for the treatment is preferably 3 to 35 parts by mass with respect to 100 parts by mass of the inorganic fine particles for excellent developability in a high temperature and high humidity environment.

Hydrophobic silica which is obtained by subjecting silica to hydrophobic treatment with hexamethyldisilazane and then further treating with the silicone oil, are preferably used in the present invention. A treatment using hexamethyldisilazane is an excellent, uniform treatment and provides a toner with satisfactory fluidity. However, stability of charge amount in a high temperature and high humidity environment is not easily obtained through treatment with hexamethyldisilazane alone. In contrast, a treatment with the silicone oil allows the toner retain to high charge amount under a high temperature and high humidity environment. However, it is difficult for silicone oil to uniformly treat. Therefore, an amount of the silicone oil required for a uniform treatment becomes large and fluidity easily degrades. A treatment with the silicone oil following the treatment with hexamethyldisilazane enables a uniform treatment with a small amount of the oil, thus realizing both high fluidity and charge stability in a high temperature and high humidity environment.

An example of a treatment using hydrophobic silica according to the present invention is described below.

Base silica is charged into a treatment tank, and a prescribed amount of hexamethyldisilazane is added drop wise or by atomizing and then sufficiently mixed while stirring inside the treatment tank using an agitating blade or the like. At this time, hexamethyldisilazane can be treated by diluting with a solvent such as alcohol. The base silica, containing a mixed and dispersed hydrophobic agent, forms powder liquid at this time. The powder liquid is heated in a nitrogen atmosphere to a temperature of the boiling point or above of hexamethyldisilazane (preferably 150 to 250° C.) and is refluxed for 0.5 to 5 hours while stirring. Then, an excess amount of the hydrophobic agent can be removed as required.

A known technique may be used for the hydrophobic treatment of a surface of the base silica using the silicone oil, and an example thereof includes charging the base silica fine particles into the treatment tank, and mixing the silica fine particles and the silicone oil while stirring inside the treatment tank with an agitating blade or the like, similarly to the hexamethyldisilazane treatment. The silicone oil may be directly mixed using a mixer such as a Henschel mixer or the silicone oil may be atomized onto the base silica particles. Alternatively, the silicone oil may be dissolved or dispersed in an appropriate solvent and mixed with the base silica fine particles, and then the solvent may be removed.

A preferable method used for the treatment with the silane compound and the silicone oil include treating the base silica fine particles with the silane compound, atomizing the silicone oil, followed by heating at 200° C. or more.

A preferable hydrophobic treatment method according to the present invention is a batch-type treatment method involving placing a prescribed amount of the base silica fine particles inside a batch reactor, followed by performing treatment inside the batch reactor while stirring at high speed. The hydrophobic silica fine particles obtained from the batch-type treatment method are subjected to a uniform treatment and have stable quality with good reproducibility.

The amount of the hydrophobic silica fine particles added depends on a kind or a function thereof or the like, but is preferably 0.1 to 5 parts by mass, more preferably 0.1 to 3 parts by mass with respect to 100 parts by mass of the toner particles.

External additives other than the silica fine particles may be added to the magnetic toner of the present invention as required. Examples of the other external additives include resin fine particles or inorganic fine particles serving as a charge adjuvant, a conductivity imparting agent, a fluidity imparting agent, a caking inhibitor, a lubricant, and an abrasive.

Specific examples of the other external additives include: lubricants such as a fluorine resin, zinc stearate, and polyvinyl fluoride (preferably polyvinyl fluoride); abrasives such as cerium oxide, silicon carbide, and strontium titanate (preferably strontium titanate); and fluidity imparting agents such as titanium oxide and aluminum oxide (in particular, hydrophobic compounds). Examples of the other external additives which can be used in a small amount include: caking inhibitors; conductivity imparting agents such as carbon black, zinc oxide, antimony oxide, and tine oxide; and developability improving agents such as antipolar white fine particles and black fine particles.

The magnetic toner of the present invention can be produced using a general method of forming the toner particles used for developing a static image. Materials used for the magnetic toner of the present invention include at least the binder resin and the magnetic iron oxides described above, and optionally other materials such as a colorant, a wax, and a charge control agent.

For preparing the toner according to the present invention, the following method is mentioned. The toner ingredients be sufficiently mixed using a mixer such as a ball mill. Then, the mixed materials are kneaded well using a thermal kneader such as heated rolls, a kneader, or an extruder. The kneaded product is cooled to solidify, coarsely pulverized, and then finely pulverized. The pulverized product is classified and then is subjected to surface modification of the toner particles using the surface modification device. Alternatively, the pulverized product may preferably be subjected to surface modification and then classified. Further, the toner according to the present invention can be produced by sufficiently mixing the desired additives as required using a mixer such as a Henschel mixer.

Known devices can be used for producing the magnetic toner of the present invention, and examples of the mixer include: HENSCHEL MIXER (manufactured by Mitsui Mining Co., Ltd.); SUPER MIXER (manufactured by Kawata Mfg. Co., Ltd.); RIBOCONE (manufactured by Okawara Mfg. Co., Ltd.); NAUTA MIXER, TURBULIZER, and CYCLOMIX (manufactured by Hosokawa Micron Corporation); SPIRAL PIN MIXER (manufactured by Pacific Machinery & Engineering Co., Ltd.); and REDIGE MIXER (manufactured by Matsubo Corporation).

Further, examples of the kneader include: KRC KNEADER (manufactured by Kurimoto, Ltd.); BUSS-CO-KNEADER (manufactured by Coperion BUSS AG); TEM EXTRUDER (manufactured by Toshiba Machine Co., Ltd.); TEX TWIN SCREW KNEADER (manufactured by Japan Steel Works, Ltd.); PCM KNEADER (manufactured by Ikegai, Ltd.); THREE ROLL MILL, MIXING ROLL MILL, KNEADER (manufactured by Inoue-Nissei Engineering Pte., Ltd.); KNEADEX (manufactured by Mitsui Mining Co., Ltd.); MS TYPE PRESSURIZING KNEADER, and KNEADER RUDER (manufactured by Moriyama Co., Ltd.); and BANBURY MIXER (manufactured by Kobe Steel, Ltd.).

Further, examples of the pulverizer include: COUNTER JET MILL, MICRON JET, and INOMIZER (manufactured by Hosokawa Micron Corporation); IDS TYPE MILL, and PJM JET PULVERIZER (manufactured by Nippon Pneumatic Mfg. Co., Ltd.); CROSSJET MILL (manufactured by Kurimoto, Ltd.); ULMAX (manufactured by Nisso Engineering Co., Ltd.); SK JET-O-MILL (manufactured by Seisin Enterprise Co., Ltd.); CLIPTRON (manufactured by Kawasaki Heavy Industries, Ltd.); TURBO MILL (manufactured by Turbo Kogyo Co., Ltd.); and SUPER ROTOR (manufactured by Nisshin Engineering Inc.).

Further, examples of the classifier include: CLASSIEL, MICRON CLASSIFIER, and SPEDIC CLASSIFIER (manufactured by Seisin Enterprises Co., Ltd.); TURBO CLASSIFIER (manufactured by Nisshin Engineering Co., Ltd.); MICRON SEPARATOR, TURBOPLEX (ATP), and TSP SEPARATOR (manufactured by Hosokawa Micron Co., Ltd.); ELBOW-JET (manufactured by Nittetsu Mining Co., Ltd.); DISPERSION SEPARATOR (manufactured by Japan Pneumatic Co., Ltd.); and YM MICROCUT (manufactured by Yasukawa Electric Co., Ltd.).

Further, examples of the sieving device for sieving coarse particles or the like include: ULTRA SONIC (manufactured by Koei Sangyo Co., Ltd.); RESONA SIEVE, and GYRO SIFTER (manufactured by Tokuju Corporation); VIBRA-SONIC SYSTEM (manufactured by Dalton Corporation); SONICLEAN (manufactured by Sintokogio Co., Ltd.); TURBO SCREENER (manufactured by Turbo Kogyo Co., Ltd.); MICRO SIFTER (manufactured by Makino Mfg. Co., Ltd.); and CIRCULAR OSCILLATION SCREENS.

EXAMPLE

The basic construction and features of the present invention have been described above. Hereinafter, the present invention is specifically described by examples. However, the present invention is not limited to these examples.

Table 1 below shows Ti chelate compounds to be used in examples.

TABLE 1

| Compound No. | Ligand | Countercation |
|---|---|---|
| Ti chelate Compound (1) | 1,2-ethandiol | $K^+$ |
| Ti chelate Compound (2) | 1,3-propanediol | $K^+$ |
| Ti chelate Compound (3) | Succinic acid | $K^+$ |
| Dehydrate of Ti chelate Compound (9) | Oxalic acid | $K^+$ |

Binder Resin Production Example 1

| | |
|---|---|
| Terephthalic acid: | 18 parts by mass |
| Isophthalic acid: | 3 parts by mass |
| Trimellitic anhydride: | 7 parts by mass |
| Bisphenol derivative represented by the formula (A) (R: a propylene group, x + y = 2.2): | 70 parts by mass |
| Novolak type phenolic resin (of about 5.6 phenol groups) added with 5.6 mole EO: | 2 parts by mass |

0.5 parts by mass of the Ti chelate compound (1) and 0.5 parts by mass of the Ti chelate compound (2) were added as catalysts to the above materials. Then, the mixture was subjected to condensation polymerization at 230° C. to yield a binder resin 1 having a polyester component (Tg=59° C., a peak molecular weight Mp=8,600, THF insoluble matter=28% by mass). The content of the polyester component in the binder resin was 100% by mass.

Binder Resin Production Example 2

300 parts by mass of xylene was charged into a four-necked flask. Then, the air in the flask was sufficiently substituted by nitrogen while stirring the xylene. After that, the temperature was raised for reflux. A mixed solution of 75 parts by mass of styrene, 18 parts by mass of 2-ethylhexyl acrylate, 7 parts by mass of acrylic acid, and 2 parts by mass of di-tert-butyl peroxide was dropped into the flask under the reflux over 4 hours. After that, the mixture was held for 2 hours to complete polymerization, thereby obtaining a resin solution having a vinyl copolymer unit component. Then, the organic solvent in the resin solution was distilled out, and the resultant resin was cooled and solidified. The resin was then pulverized to yield a resin having a vinyl copolymer unit component (Tg=58° C., a peak molecular weight (Mp)=9,200, THF insoluble matter=0% by mass).

| | |
|---|---|
| The above resin having a vinyl copolymer unit component: | 10 parts by mass |
| Terephthalic acid: | 20 parts by mass |
| Isophthalic acid: | 5 parts by mass |
| Trimellitic anhydride: | 3 parts by mass |
| Bisphenol derivative represented by the formula (A) (R: a propylene group, x + y = 2.2): | 70 parts by mass |
| Novolak type phenolic resin (of about 5.6 phenol groups) added with 5.6 mole EO: | 2 parts by mass |

Subsequently, 1.0 part by mass of the Ti chelate compound (2) was added as a catalyst to the above materials. Then, the mixture was subjected to condensation polymerization at 230° C. to yield a binder resin 2 having a polyester component (Tg=58° C., a peak molecular weight Mp=9,100, THF insoluble matter=16% by mass). The content of the polyester component in the binder resin was about 87% by mass.

Binder Resin Production Example 3

| | |
|---|---|
| Terephthalic acid: | 20 parts by mass |
| Dodecenylsuccinic acid: | 5 parts by mass |
| Trimellitic anhydride: | 8 parts by mass |
| Bisphenol derivative represented by the formula (A) (R: a propylene group, x + y = 2.2): | 50 parts by mass |
| Bisphenol derivative represented by the formula (A) (R: an ethylene group, x + y = 2.2): | 15 parts by mass |
| Novolak type phenolic resin (of about 5.6 phenol groups) added with 5.6 mole EO: | 2 parts by mass |

1.0 part by mass of the Ti chelate compound (2) was added as a catalyst to the above materials. Then, the mixture was subjected to condensation polymerization at 230° C. to yield a binder resin 3 having a polyester component (Tg=57° C., a peak molecular weight Mp=7,600, THF insoluble matter=36% by mass). The content of the polyester component in the binder resin was 100% by mass.

Binder Resin Production Example 4

| | |
|---|---|
| Terephthalic acid: | 15 parts by mass |
| Dodecenylsuccinic acid: | 5 parts by mass |
| Trimellitic anhydride: | 8 parts by mass |
| Bisphenol derivative represented by the formula (A) (R: a propylene group, x + y = 2.2): | 50 parts by mass |
| Bisphenol derivative represented by the formula (A) (R: an ethylene group, x + y = 2.2): | 20 parts by mass |
| Novolak type phenolic resin (of about 5.6 phenol groups) added with 5.6 mole EO: | 2 parts by mass |

1.0 part by mass of the Ti chelate compound (1) was added as a catalyst to the above materials. Then, the mixture was subjected to condensation polymerization at 230° C. to yield a binder resin 4 having a polyester component (Tg=56° C., a peak molecular weight Mp=8,100, THF insoluble matter=11% by mass). The content of the polyester component in the binder resin was 100% by mass.

Binder Resin Production Example 5

A binder resin 5 was yielded in the same manner as in Binder Resin Production Example 4 except that tetramethyltitanate was used instead of the Ti chelate compound (1). The content of the polyester component in the resin was 100% by mass.

Binder Resin Production Example 6

| | |
|---|---|
| Terephthalic acid: | 18 parts by mass |
| Isophthalic acid: | 3 parts by mass |
| Trimellitic anhydride: | 7 parts by mass |
| Bisphenol derivative represented by the formula (A) (R: a propylene group, x + y = 2.2): | 70 parts by mass |
| Novolak type phenolic resin (of about 5.6 phenol groups) added with 5.6 mole EO: | 2 parts by mass |

1 part by mass of dihydrate of the Ti chelate compound (9) was added as a catalyst to the above materials. Then, the mixture was subjected to condensation polymerization at 230° C. to yield a binder resin 6 having a polyester component (Tg=60° C., a peak molecular weight Mp=8,800, THF insoluble matter=31%by mass). The content of the polyester component in the binder resin was 100% by mass.

Magnetic Iron Oxide Particles Production Example 1

Silicate of soda was added to an aqueous solution of ferrous sulfate in such a manner that the content of an Si element would be 0.50% with respect to an iron element. After that, a caustic soda solution was mixed with the above solution to prepare an aqueous solution containing iron hydroxide. Air was blown into the aqueous solution while the pH of the aqueous solution was adjusted to 10. Then, an oxidation reaction was performed at a temperature of 80 to 90° C. to prepare slurry for producing a seed.

Once the production of a seed was observed, an aqueous solution of ferrous sulfate was additionally added to the slurry as required. Then, air was blown into the slurry while the pH of the slurry was adjusted to 10 to thereby progress an oxidation reaction. In the meantime, the progress rate of the reaction was examined while the concentration of unreacted iron hydroxide was examined. At the same time, an Si element distribution in a magnetic iron oxide was controlled by adjusting the pH of the solution stepwise. In the stepwise adjustment, for example, the pH of the solution was adjusted to 9 at an early stage of the oxidation reaction, to 8 at an intermediate stage of the oxidation reaction, and to 6 at a later stage of the oxidation reaction. Thus, the oxidation reaction was completed.

Subsequently, a water-soluble aluminum salt was added to an alkaline suspension in which a magnetic iron oxide particle containing the Si element was produced, in such a manner that the content of the water-soluble aluminum salt would be 0.20% with respect to the produced particle in aluminum element equivalent. After that, the pH of the suspension was adjusted to be within the range of 6 to 8 to precipitate the water-soluble aluminum salt as a hydroxide of aluminum on the magnetic iron oxide surface. Then, the precipitate was filtered out, washed with water, dried, and crushed to obtain magnetic iron oxide particles having aluminum elements on the magnetic iron oxide particles surface. The obtained magnetic iron oxide particles were cleaned, filtered, and dried according to the conventional method.

Primary particles of the obtained magnetic iron oxide particles were agglomerated to form an agglomerate. A compression force and a shearing force were applied to the agglomerate of the magnetic iron oxide particles using a mix muller. The agglomerate was crushed to make the primary particles of the magnetic iron oxide particles. At the same time, the surfaces of the magnetic iron oxide particles were smoothened. Thus, a magnetic iron oxide particle 1 having properties shown in Table 2 was obtained.

Magnetic Iron Oxide Particles Production Examples 2 and 3

The addition amounts and addition timings of silicate of soda and the water-soluble aluminum salt, the pH of the aqueous solution, and the like were changed to obtain magnetic iron oxide particles 2 to 4 having physical properties shown in Table 2.

TABLE 2

| Magnetic Iron Oxide | Shape | Si (%) | Al (%) | ($Am^2$/kg) | ($Am^2$/kg) | Particle diameter (μm) |
|---|---|---|---|---|---|---|
| Magnetic Iron Oxide Particles 1 | Sphere | 0.52 | 0.21 | 84.9 | 6.8 | 0.16 |
| Magnetic Iron Oxide Particles 2 | Octahedron | 0.13 | 0.00 | 77.1 | 14.8 | 0.11 |
| Magnetic Iron Oxide Particles 3 | Sphere | 0.85 | 0.34 | 80.3 | 1.1 | 0.24 |

[Preparation of Toner 1]

| | |
|---|---|
| Binder resin 1 | 100 parts by mass |
| Magnetic iron oxide particles | 100 parts by mass |
| Monoazo iron compound (1) (the counter ion of which is a mixture of $NH_4^+$ and $Na^+$, the mixing ratio of $NH_4^+$ to $Na^+$ ($NH_4^+/Na^+$) = 7/3) | 2 parts by mass |
| Aluminum salicylate compound (14) | 1 part by mass |
| Fisher-Tropsch wax (DSC peak top temperature = 104° C., Mw/Mn = 1.8) | 4 parts by mass |

The above materials were pre-mixed by using a HENSCHEL MIXER. Then, the mixed materials were melted and kneaded by using a two-axis extruder heated to 130° C. After the kneaded product was cooled, the kneaded product was roughly pulverized using a hammer mill, thus obtaining a toner coarse pulverized material. The resultant coarse pulverized material was finely pulverized through mechanical pulverization by using a mechanical pulverizer TURBO MILL (manufactured by Turbo Industry Ltd.; rotator and stator surfaces were coated with chromium alloy plating containing chromium carbide (plating thickness 150 μm, surface hardness HV 1050)), with an inlet air temperature of the pulverizer, an outlet air temperature of the pulverizer, and a temperature of a coolant for cooling a pulverizing rotor and a liner adjusted to −15° C., 48° C., and −5° C., respectively. The fine powder and coarse powder of the obtained fine pulverized material were strictly classified and removed at the same time by using a multidivision classifier that utilizes the Coanda effect (manufactured by Nittetsu Mining Co., Ltd., ELBOW-JET classifier).

The classified product was subjected to surface modification with the surface modification apparatus shown in FIG. 1. At that time, in this example, 8 square disks were placed on an upper part of the dispersion rotor. A spacing between the guide ring and each of the 8 square disks on the upper part of the dispersion rotor was set to 30 mm, and a spacing between the dispersion rotor and the liner was set to 5 mm. A rotating peripheral speed of the dispersion rotor was set to 100 m/sec, and a blower air quantity was set to 15 $m^3$/min. An input amount of the fine pulverized product was set to 20 kg, and a cycle time was set to 60 sec. A temperature of a coolant to be passed through the jacket was set to 0° C., and the cool air temperature T1 was set to −20° C. In addition, the rpm of a classifying rotor was controlled to obtain negatively-charged toner particles having a weight average particle diameter (D4) of 6.2 μm.

A negatively-charged toner 1 was prepared by mixing 100 parts by mass of the negatively-charged toner particles and 1.0 part by mass of hydrophobic silica fine particles by means of the Henschel Mixer, the hydrophobic silica fine particles being obtained by treatment of dry silica of BET 200 $m^2$/g with hexamethyldisilazane, followed by treatment with dimethyl silicone oil. Table 3 shows the values for the physical properties of the toner 1 measured by FPIA 2100.

[Preparation of Toners 2 to 6 and 8]

Toners 2 to 6 and a toner 8 having physical properties shown in Table 3 were prepared in the same manner as in the toner 1 except that binder resins and magnetic iron oxide particles were changed as shown in Table 3, and that operating conditions for the mechanical pulverizer and for the surface modification apparatus were finely adjusted.

[Preparation of Toner 7]

A toner 7 having physical properties shown in Table 3 was prepared in the same manner as in the toner 1 except for the following. First, a binder resin and a magnetic iron oxide particles shown in Table3were used. Second, no aluminum salicylate compound was added. Third, 1 part by mass of a monoazo chromium compound was added instead of the monoazo iron compound. Fourth, a jet stream type pulverizer was used instead of the mechanical pulverizer and no surface modification was performed on the surface modification apparatus. Fifth, hydrophobic silica treated with hexamethyldisilazane was used as hydrophobic silica.

TABLE 3

| | Binder resin | Magnetic iron oxide particles | ($Am^2$/kg) | ($Am^2$/kg) | Average circularity |
|---|---|---|---|---|---|
| Toner 1 | Binder resin 1 | Magnetic iron oxide particles 1 | 39.6 | 3.1 | 0.953 |
| Toner 2 | Binder resin 2 | Magnetic iron oxide particles 1 | 39.7 | 3.0 | 0.967 |
| Toner 3 | Binder resin 1 | Magnetic iron oxide particles 1 | 39.3 | 3.2 | 0.941 |
| Toner 4 | Binder resin 1 | Magnetic iron oxide particles 1 | 38.8 | 3.1 | 0.936 |
| Toner 5 | Binder resin 3 | Magnetic iron oxide particles 3 | 37.2 | 0.5 | 0.932 |
| Toner 6 | Binder resin 4 | Magnetic iron oxide particles 2 | 34.4 | 7.0 | 0.930 |
| Toner 7 | Binder resin 5 | Magnetic iron oxide particles 3 | 34.1 | 6.8 | 0.918 |
| Toner 8 | Binder resin 6 | Magnetic iron oxide particles 1 | 39.7 | 3.2 | 0.965 |

Examples 1 to 7, Comparative Example 1

Subsequently, the prepared toners 1 to 8 were evaluated according to the method described below. Table 4 shows the results of the evaluation.

The following evaluations were made by using a machine obtained by remodeling a laser printer LASER JET 4300 manufactured by Hewlett-Packard (A4 size, vertical orientation, having a process speed of about 325 mm/sec) to 55 ppm.

(1) Image Density

Under each of a normal-temperature and normal-humidity environment (23° C., 60% RH), a low-temperature and low-humidity environment (15° C., 10% RH), and a high-temperature and high-humidity environment (32.5° C., 80% RH), a 20,000-sheet image output test was performed on plain paper for a copier (75 g/$m^2$) at 2-sheet intervals and at an image print ratio of 2%. However, a 25,000-sheet image output test was performed for the toner 8. Table 4 shows the results.

A relative density is measured by a reflection densitometer "MACBETH REFLECTION DENSITOMETER" (manufactured by Macbeth Ltd.) as a relative density with respect to a print-out image of a white ground portion of 0.00.

(2) Toner Consumption

Developing conditions were set in such a manner that a line width of a 2-dot line would be 190 μm under the normal-temperature and normal-humidity environment (23° C., 60% RH). A 5,000-sheet image output test was performed on plain paper for a copier (75 g/$m^2$) while the sheets were continuously passed at an image print ratio of 4%. Weights of a developing machine before and after the image output test were measured to calculate a toner consumption per one image.

(3) Fog

Fog was measured in a 10,000-sheet endurance test under the low-temperature and low-humidity environment (15° C., 10%RH) The method of measuring fog was as follows. An average reflectance Dr (%) of plain paper before image output was measured by using a reflectometer equipped with a complementary color filter for a measured color ("REFLECTOMETERODELTC-6DS" manufactured by Tokyo Denshoku). Meanwhile, a solid white image was outputted on plain paper, and then a reflectance Ds (%) of the solid white image was measured. Fog (%) was calculated from the following equation (3).

$$\text{Fog}(\%)=Dr(\%)-Ds(\%) \qquad \text{Equation (3)}$$

TABLE 4

| | Toner used | Normal temperature, normal-humidity Image density | Low temperature, low humidity Image density | Low temperature, low humidity Fog (%) | High temperature, high humidity Image density | Toner consumption (mg/sheet) |
|---|---|---|---|---|---|---|
| Example 1 | Toner 1 | 1.52 | 1.55 | 0.2 | 1.48 | 41 |
| Example 2 | Toner 2 | 1.53 | 1.53 | 0.6 | 1.49 | 41 |
| Example 3 | Toner 3 | 1.45 | 1.50 | 1.4 | 1.41 | 44 |
| Example 4 | Toner 4 | 1.42 | 1.46 | 2.0 | 1.37 | 46 |
| Example 5 | Toner 5 | 1.37 | 1.41 | 3.3 | 1.34 | 49 |
| Example 6 | Toner 6 | 1.29 | 1.34 | 3.9 | 1.20 | 52 |
| Comparative Example 1 | Toner 7 | 1.24 | 1.26 | 5.3 | 1.11 | 58 |
| Example 7 | Toner 8 | 1.54 | 1.55 | 0.3 | 1.50 | 40 |

The magnetic toner of the present invention uses a binder resin having a polyester component using a Ti chelate compound as a catalyst, and magnetic properties of the magnetic toner are controlled. As a result, developability and environmental stability can be improved, and the toner consumption can be reduced.

What is claimed is:

1. A magnetic toner comprising magnetic toner particles each comprising at least a monoazo iron compound, an aluminum compound of an aromatic hydroxyl carboxylic acid, a binder resin and a magnetic iron oxide, wherein:

the magnetic toner has a saturation magnetization σs being in the range of 5 to 60 $Am^2/kg$ and a remanent magnetization or being in the range of 0.1 to 10.0 $Am^2/kg$ in a measured magnetic field of 795.8 kA/m;

the binder resin contains a polyester component polymerized by using a Ti chelate compound having a ligand selected from the group consisting of a diol, a dicarboxylic acid, and an oxycarboxylic acid as a catalyst; and the Ti chelate compound is represented by any one of the following formulae (I) to (IV):

Formula (I)

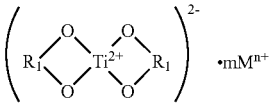

in the formula (I), $R_1$ denotes one of an alkylene group or an alkenylene group each having 2 to 10 carbon atoms and may have a substituent, M denotes a countercation, m denotes a cation number, n denotes a cation valence, n=2 when m=1, n=1 when m=2, and M denotes one of a hydrogen ion, an alkali metal ion, an ammonium ion, or an organic ammonium ion when n=1, or denotes an alkali earth metal ion when n=2;

Formula (II)

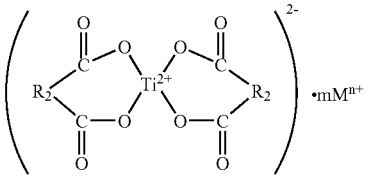

in the formula (II), $R_2$ denotes one of an alkylene group or an alkenylene group each having 1 to 10 carbon atoms and may have a substituent, M denotes a countercation, m denotes a cation number, n denotes a cation valence, n=2 when m=1, n=1 when m=2, and M denotes one of a hydrogen ion, an alkali metal ion, an ammonium ion, or an organic ammonium ion when n=1, or denotes an alkali earth metal ion when n=2;

Formula (III)

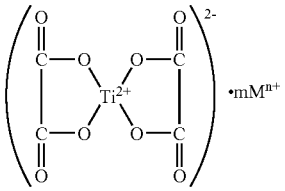

in the formula (III), M denotes a countercation, m denotes a cation number, n denotes a cation valence, n=2 when m=1, n=1 when m=2, and M denotes one of a hydrogen ion, an alkali metal ion, an ammonium ion, or an organic ammonium ion when n=1, or denotes an alkali earth metal ion when n=2;

Formula (IV)

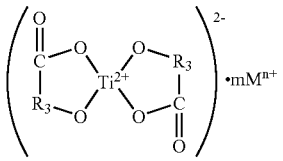

in the formula (IV), $R_3$ denotes one of an alkylene group or an alkenylene group each having 1 to 10 carbon atoms and may have a substituent, M denotes a countercation, m denotes a cation number, n denotes a cation valence, n=2 when m=1, n=1 when m=2, and M denotes one of a hydrogen ion, an alkali metal ion, an ammonium ion, or an organic ammonium ion when n=1, or denotes an alkali earth metal ion when n=2, wherein the polyester component comprises a compound having a structure containing oxyalkylene ether of a novolak phenolic resin as an alcohol component; and wherein the metal compound of an aromatic hydroxyl carboxylic acid is represented by the following formula (13):

Formula (13)

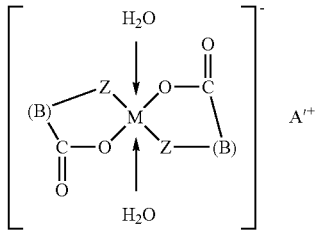

wherein M represents aluminum; (B) represents (I) a group of the following structure:

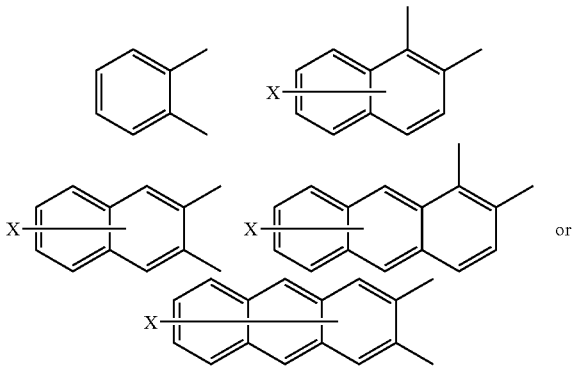

which may contain a substituent, wherein X represents a hydrogen atom, a halogen atom, or a nitro group; or (ii)

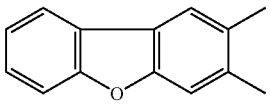

-continued

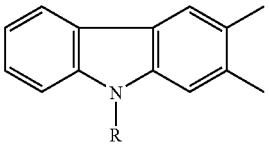

or

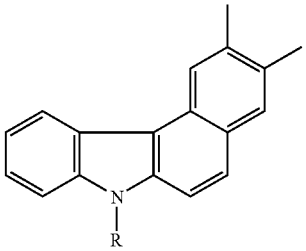

wherein, R represents a hydrogen atom, an alkyl group having 1 to 18 carbon atoms, or an alkenyl group having 2 to 18 carbon atoms, $A'^{+}$ represents hydrogen, a sodium ion, a potassium ion, an ammonium ion, or an aliphatic ammonium ion and Z represents —O— or —C(=O)—O—.

2. A magnetic toner according to claim 1, wherein the magnetic iron oxide comprises 0.1 to 2.0% by mass of an Si element.

3. A magnetic toner according to claim 1, further comprising hydrophobic silica treated with hexamethyldisilazane and with silicone oil.

4. A magnetic toner according to claim 1, wherein an average circularity of the magnetic toner particles of the magnetic toner which have equivalent circle diameters of 3 μm or more and 400 μm or less measured with a flow particle image analyzer, is 0.930 or more and less than 0.970.

5. A magnetic toner according to claim 1, wherein the Ti chelate compound is represented by the formula (I).

6. A magnetic toner according to claim 1, wherein the binder resin contains a polyester component polymerized by using Ti chelate compounds (1) and (2) together thereof:

Ti chelate compound (1)

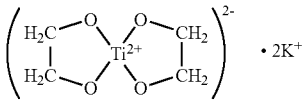

Ti chelate compound (2)

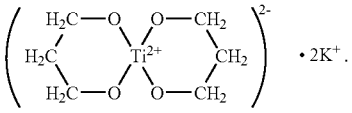

* * * * *